US005378596A

United States Patent [19]

Naruse et al.

[11] Patent Number: 5,378,596

[45] Date of Patent: Jan. 3, 1995

[54] SILVER HALIDE COLOR PHOTOGRAPHIC MATERIAL

[75] Inventors: Hideaki Naruse; Makoto Suzuki, both of Kanagawa, Japan

[73] Assignee: Fuji Photo Film Co., Ltd., Kanagawa, Japan

[21] Appl. No.: 982,619

[22] Filed: Nov. 27, 1992

[30] Foreign Application Priority Data

Nov. 27, 1991 [JP] Japan ..... 3-335841

[51] Int. Cl.[6] ..... G03C 7/38; G03C 7/34

[52] U.S. Cl. ..... 430/549; 430/552; 430/553; 430/558

[58] Field of Search ..... 430/549, 552, 553, 558, 430/384, 385

[56] References Cited

U.S. PATENT DOCUMENTS

| | | | |
|---|---|---|---|
| 4,857,444 | 8/1989 | Hirose et al. | 430/553 |
| 4,883,746 | 11/1989 | Shimada et al. | 430/552 |
| 4,910,127 | 3/1990 | Sakaki et al. | 430/558 |
| 5,084,375 | 1/1992 | Umemoto et al. | 430/553 |
| 5,091,297 | 2/1992 | Fukunaga et al. | 430/558 |
| 5,270,153 | 12/1993 | Suzuki et al. | 430/558 |

FOREIGN PATENT DOCUMENTS

| | | | |
|---|---|---|---|
| 0488248 | 6/1992 | European Pat. Off. . | |
| 0491197 | 6/1992 | European Pat. Off. . | |
| 2273746 | 11/1990 | Japan | 430/553 |

*Primary Examiner*—Lee C. Wright
*Attorney, Agent, or Firm*—Sughrue, Mion, Zinn, Macpeak & Seas

[57] ABSTRACT

A silver halide color photographic material comprises a support having provided thereon at least one silver halide emulsion layer containing at least one pyrrolotriazole cyan coupler represented by the following Formula (I) or (II) and at least one phenol or 1-naphtol cyan coupler represented by the following Formulas (III), (IV), (V) and (VI):

(I)

(II)

wherein Za and Zb each represents —C($R_3$)= or —N=; $R_1$ and $R_2$ each independently represents an electron attractive group having a Hammett's substituent constant $\sigma_p$ of 0.2 or more and the sum of the $\sigma_p$ values of $R_1$ and $R_2$ is 0.65 or more; $R_3$ represents a hydrogen atom or a substituent; X represents a hydrogen atom or a splitting-off group;

(III)

(IV)

(V)

(VI)

17 Claims, No Drawings

SILVER HALIDE COLOR PHOTOGRAPHIC MATERIAL

FIELD OF THE INVENTION

The present invention relates to a silver halide color photographic material which has improved dye image fastness and color reproducibility, achieved by the combined use of at least one novel pyrrolotriazole cyan coupler and at least one other cyan coupler.

BACKGROUND OF THE INVENTION

In silver halide color photographic materials, phenol type and naphthol type couplers are well known as cyan couplers in general use.

In recent years, research efforts have been directed to developing novel cyan couplers in which color developability (which relates to the coupling activity and the spectral absorption coefficient of the dye obtained), fastness of the dye image obtained and the absorption properties of the dye image are improved in comparison to phenol type and naphthol type cyan couplers, and high color developability, dye image fastness, and excellent color reproducibility can be provided. Couplers developed through such efforts include, for example, the 3-hydroxypyridine compounds described in European Patent Publication 333,185, the 3H-2-dicyanomethylidenethiazoles described in European Patent Publication 362,808, the 3-dicyanomethylidene- 2,3-dihydrobenzothiophene-1,1-dioxides described in JP-A-64-32260 (the term "JP-A" as used herein means an unexamined Japanese patent application), the pyrazoloazoles described in JP-A-63-264753 and U.S. Pat. No. 4,873,183, the imidazoles described in U.S. Pat. Nos. 4,818,672 and 4,921,783, and JP-A-3-48243, the pyrazolopyrimidones and pyrazoloquinazolones described in European Patent Publications 304,001, 329,036 and 374,871 and JP-A-2-85851, and the condensed triazoles described in European Patent Publication 342,637.

However, the present state of the art is such that the performances of these proposed novel cyan couplers can not simultaneously satisfy the above requirements for excellent color developability, dye image fastness and color reproducibility, and they can not be put to practical use without further research and development.

Further, it has been found that the use of combinations of these couplers, either with or without the above phenol type and naphthol type cyan couplers, tends to degrade the respective couplers' properties rather than to provide an additive or synergystic effect.

Couplers having the same basic structure as the pyrrolotriazole cyan couplers according to the present invention are shown by Formulas (IX), (XIII), (XV) and (XX) of Formulas (II) to (XXXV) in JP-A-62-27855, and two specific examples of couplers within the scope of each of Formulas (IX), (XIII), (XV), and (XX) are shown. Also, in Formulas (I) and (II) of JP-A-62-279340, the same basic structure is shown and 42 specific examples of the compounds are given.

However, the compounds described in JP-A-62-278552 and JP-A-62-279340 are magenta couplers and are different from the cyan couplers of the present invention, which have the same basic structure as that of the above compounds but provide a cyan dye by a coupling reaction with an oxidation product of a color developing agent according to a substituent introduced therein.

Further, in JP-A-1-288855, the compounds represented by Formulas (IV) to (XVII) are disclosed as cyan couplers with a novel basic structure. Of them, the compounds represented by Formulas (IV) and (V) are described as pyrrolotriazole type cyan couplers. In particular, while the compounds represented by Formula (IV) are pyrrolotriazole type cyan couplers with the same basic structure as the couplers of the present invention, the structure shown in the above publication has a different active site from that of the couplers of the present invention, at which the coupling reaction with an oxidation product of a color developing agent occurs. The coupling activity of the couplers exemplified in the above publication is low and it is difficult to put them to practical use.

As described above, the single or combined use of the above novel cyan couplers including the hydroxypyrimidine type cyan couplers as well as the conventional phenol type and naphthol type cyan couplers can not provide performance adequate to simultaneously satisfy all of the requirements for color developability, dye image storing performance, fastness and color reproducibility. The combined use thereof rather reduces and deteriorates the respective excellent performances thereof.

Accordingly, it would be desirable to provide a combination of novel cyan couplers which improves upon the defects of the respective couplers and gives better performance even if used in combination with conventional cyan couplers while maintaining the excellent performances held by the respective couplers.

SUMMARY OF THE INVENTION

Accordingly, a first object of the present invention is to provide a silver halide color photographic material capable of providing excellent storage stability and fastness.

A second object of the present invention is to provide a silver halide color photographic material having a high color developability.

A third object of the present invention is to provide a silver halide color photographic material capable of providing excellent color reproducibility.

The investigations made by the present inventors in order to achieve the above objects have resulted in finding that they can be achieved by a silver halide color photographic material comprising a support having provided thereon at least one silver halide emulsion layer containing at least one pyrrolotriazole cyan coupler represented by the following Formula (I) or (II) and at least one coupler selected from the phenol or 1-naphtol cyan couplers represented by the following Formulas (III), (IV), (V) and (VI):

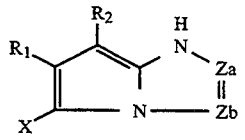

(I)

-continued (II)

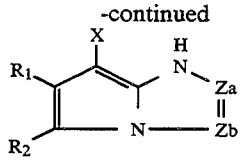

wherein Za and Zb each represents —C($R_3$)= or —N=, provided that one of Za and Zb is —N= and the other is —C($R_3$)=; $R_1$ and $R_2$ each independently represents an electron attractive group having a Hammett's substituent constant $\sigma_p$ of 0.2 or more and the sum of the $\sigma_p$ values of $R_1$ and $R_2$ is 0.65 or more; $R_3$ represents a hydrogen atom or a substituent; X represents a hydrogen atom or a group capable of splitting off upon a reaction with an oxidation product of an aromatic primary amine color developing agent; the group represented by $R_1$, $R_2$, $R_3$ or X may be a divalent group and combine with a polymer which is higher than a dimer and which has a high molecular chain to form a homopolymer or a copolymer;

(III)

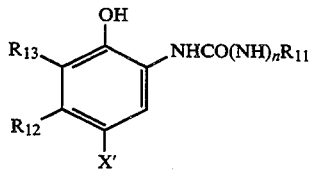

(IV)

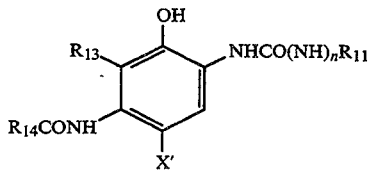

(V)

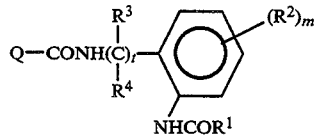

(VI)

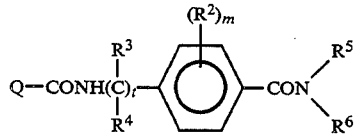

in Formulas (III) and (IV), $R_{11}$ represents an alkyl group, an aryl group or a heterocyclic group; $R_{12}$ represents an alkyl group having two or more carbon atoms; $R_{13}$ represents a hydrogen atom, a halogen atom, an alkyl group, an aryl group, an alkoxy group, an aryloxy group, a carbonamido group, or a ureido group; $R_{14}$ represents an alkyl group, an aryl group, a heterocyclic group, an alkoxy group, an aryloxy group, or an amino group; X' represents a hydrogen atom or a group capable of splitting off upon a reaction with an oxidation product of an aromatic primary amine color developing agent; n represents 0 or 1; $R_{12}$ and $R_{13}$ in Formula (III) may be combined with each other to form a ring, and $R_{13}$ and $R_{14}$ in Formula (IV) may be combined with each other to form a ring; in Formulas (V) and (VI), Q represents a 1-naphthol coupler group which is bonded at the 2-position; $R^1$ represents a hydrogen atom, an alkyl group, an alkenyl group, an alkynyl group, a cycloalkyl group, an aralkyl group, an alkoxy group, an amino group, or an aryl group; $R^2$ represents a substituent group; $R^3$ and $R^4$ each represents a hydrogen atom, an alkyl group, an aryl group, a halogen atom, an alkoxy group, or an aryloxy group; $R^5$ and $R^6$ each represents a hydrogen atom, an alkyl group, or an aryl group; and t represents an integer of 0 to 4 and m represents an integer of 0 to 4.

The combined use of a pyrrolotriazole type cyan coupler of the present invention represented by Formula (I) or (II) and a coupler of the present invention represented by Formula (III), (IV), (V) or (VI) can provide a silver halide color photographic material which provides excellent dye image fastness and color reproducibility and gives a high color developability.

DETAILED DESCRIPTION OF THE INVENTION

The present invention will be explained below in detail.

First, Formulas (I) and (II) will be explained.

Za and Zb each represents —C($R_3$)= or —N=, provided that one of Za and Zb is —N= and the other is —C($R_3$)=.

That is, to be specific, the cyan couplers of the present invention may be represented by the following Formulas (I-a), (I-b), (II-a) and (II-b):

(I-a)

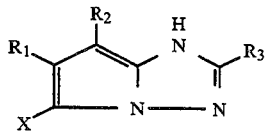

(I-b)

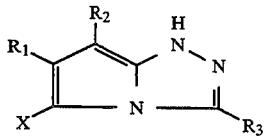

(II-a)

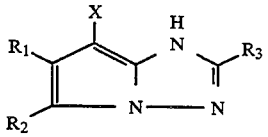

(II-b)

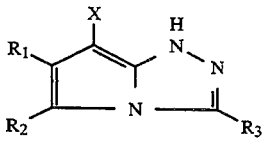

wherein $R_1$, $R_2$, $R_3$ and X have the same meaning as $R_1$, $R_2$, $R_3$ and X in Formulas (I) and (II), respectively.

$R_3$ represents a hydrogen atom or a substituent, and the substituent may be, for example, a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group. These groups may be further substituted with the substituents given immediately above as examples of $R_3$.

In more detail, $R_3$ may represent a hydrogen atom, a halogen atom (for example, a chlorine atom and a bromine atom), an alkyl group (for example, a linear or branched alkyl group having 1 to 32 carbon atoms, an aralkyl group, and a cycloalkyl group, and in more detail, for example, methyl, ethyl, propyl, isopropyl, t-butyl, tridecyl, 2-methane-sulfonylethyl, 3-(3-pentadecylphenoxy)propyl, 3-[4-{2-[4-(4-hydroxyphenylsulfonyl)phenoxy]dodecanamide}phenyl]propyl, 2-ethoxytridecyl, trifluoromethyl, cyclopentyl, and 3-(2,4-di-t-amylphenoxy),propyl) an aryl group (for example, phenyl, 4-t-butylphenyl, 2,4-di-t-amylphenyl, and 4-tetradecanamidephenyl), a heterocyclic group (for example, 2-furyl, 2-thienyl, 2-pyrimidinyl, and 2-benzothiazolyl), a cyano group, a hydroxy group, a nitro group, a carboxy group, a sulfo group, an amino group, an alkoxy group (for example, methoxy, ethoxy, 2-methoxyethoxy, 2-dodecylethoxy, and 2-methane-sulfonylethoxy), an aryloxy group (for example, phenoxy, 2-methylphenoxy, 4-t-butyl-phenoxy, 3-nitrophenoxy, 3-t-butyloxy-carbamoylphenoxy, and 3-methoxycarbamoyl), an acylamino group (for example, acetamido, benzamido, tetradecanamido, 2-(2,4-di-t-amylphenoxy)-butanamido, 4-(3-t-butyl-4-hydroxyphenoxy)-butanamido, and 2-[4-(4-hydroxyphenylsulfonyl)-phenoxy]decanamido), an alkylamino group (for example, methylamino, butylamino, dodecylamino, diethylamino, and methylbutylamino), an anilino group (for example, phenylamino, 2-chloroanilino, 2-chloro-5-tetradecanaminoanilino, 2-chloro-5-dodecyloxycarbonylanilino, N-acetylanilino, and 2-chloro-5-[2-(3-t-butyl-4-hydroxyphenoxy)dodecanamide]anilino), a ureido group (for example, phenylureido, methylureido, and N,N-dibutylureido), a sulfamoylamino group (for example, N,N-dipropylsulfamoylamino, and N-methyl-N-decylsulfamoylamino), an alkylthio group (for example, methylthio, octylthio, tetradecylthio, 2-phenoxyethylthio, 3-phenoxypropylthio, and 3-(4-t-butylphenoxy)propylthio), an arylthio group (for example, phenylthio, 2-butoxy-5-t-octylphenylthio, 3-pentadecylphenylthio, 2-carboxyphenylthio and 4-tetradecanamidephenylthio), an alkoxycarbonylamino group (for example, methoxycarbonylamino and tetradecyloxycarbonylamino), a sulfonamido group (for example, methanesulfonamido, hexadecanesulfonamido, benzenesulfonamido, p-toluenesulfonamido, octadecanesulfonamido, and 2-methoxy-5-t-butylbenzenesulfonamido), a carbamoyl group (for example, N-ethylcarbamoyl, N, N-dibutyl N,N-dibutylcarbamoyl, N-(2-dodecyloxyethyl)carbamoyl, N-methyl-N-dodecylcarbamoyl, and N-[3-(2,4-di-t-amylphenoxy)-propyl]carbamoyl), a sulfamoyl group (for example, N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (for example, methanesulfonyl, octanesulfonyl, benzenesulfonyl, and toluenesulfonyl), an alkoxycarbonyl group (for example, methoxycarbonyl, butyloxycarbonyl, dodecyloxycarbonyl, and octadecyloxycarbonyl), a heterocyclic oxy group (for example, 1-phenyltetrazole-5-oxy, and 2-tetrahydroxypyranyloxy), an azo group (for example, phenylazo, 4-methoxyphenylazo, 4-pivaloylaminophenylazo, and 2-hydroxy-4-propanoylphenylazo), an acyloxy group (for example, acetoxy), a carbamoyloxy group (for example, N-methylcarbamoyloxy and N-phenylcarbamoyloxy), a silyloxy group (for example, trimethylsilyloxy and dibutylmethylsilyloxy), an aryloxycarbonylamino group (for example, phenoxycarbonylamino), an imido group (for example, N-succinimido, N-phthalimido, and 3-octadecenylsuccinimido), a heterocyclic thio group (for example, 2-benzothiazolylthio, 2,4-di-phenoxy-1,3,5-triazole-6-thio, and 2-pyridylthio), a sulfinyl group (for example, dodecanesulfinyl, 3-pentadecylphenylsulfinyl, and 3-phenoxypropylsulfinyl), a phosphonyl group (for example, phenoxyphosphonyl, octyloxyphosphonyl, and phenylphosphonyl), an aryloxycarbonyl group (for example, phenoxycarbonyl), an acyl group (for example, acetyl, 3-phenylpropanoyl, benzoyl, and 4-dodecyloxybenzoyl), and an azolyl group (for example, imidazolyl, pyrazolyl, 3-chloropyrazole-1-yl, and triazolyl).

$R_3$ preferably represents an alkyl group, an group, a heterocyclic group, a cyano group, nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heretocyclic oxy group, an acyloxy group, a carbamoyloxy group, an aryloxycarbonylamino group, an imide group, a heterocyclic thio group, a sulfinyl group, a phosphonyl group, an aryloxycarbonyl group, an acyl group, or an azolyl group.

$R_3$ further preferably represents an alkyl group or an aryl group. $R_3$ more preferably represents an alkyl group or aryl group each having at least one substituent which provides a flocculation property, and further preferably represents an alkyl group or aryl group each having at least one alkoxy group, sulfonyl group, sulfamoyl group, carbamoyl group, acylamido group, or sulfonamido group as a substituent. $R_3$particularly preferably represents an alkyl group or aryl group each having at least one acylamido group or sulfonamido group as a substituent. Where $R_3$ is an aryl group, these substituents are more preferably substituted at least at an ortho position.

In the cyan coupler of the present invention, $R_1$ and $R_2$ each represents an electron attractive group having a $\sigma_p$ value of 0.2 or more, and a value of 0.65 or more as the total of the $\sigma_p$ values of $R_1$ and $R_2$ makes it possible to develop a color to form a cyan dye image. The total of the $\sigma_p$ values of $R_1$ and $R_2$ is preferably 0.70 or more and the upper limit thereof is not much more than 1.8.

$R_1$ and $R_2$ each represents an electron attractive group having a Hammett's substituent constant of 0.20 or more, preferably 0.30 or more. The upper limit thereof is 1.0 or less. Hammett's rule is an empirical rule which was proposed by L. P. Hammett in 1935 in order to quantitatively assess the affects exerted on the reaction or equilibrium of a benzene derivative by a substituent. The propriety of Hammett's rule is widely accepted.

The $\sigma_p$ value and the $\sigma_m$ value are the substituent constants obtained according to Hammett's rule and the values thereof are described in many publications. They are described in, for example, *Lange's Handbook of Chemistry*, Vol. 12, edited by J. A. Dean, 1979 (McGraw-Hill) and *Chemical Region*, No. 122, pp. 96 to 103, 1979 (Nankohdo). In the present invention, suitable groups for $R_1$ and $R_2$ are determined by reference to the Hammett's substituent constant $\sigma_p$ value but this does not mean that $R_1$ and $R_2$ are limited to the substituents the $\sigma_p$ values of which are described in these publications. Even if the $\sigma_p$ values of the groups are not described in the publications, they are naturally included in the scope of the present invention as long as their $\sigma_p$ values are included in the above range when measured according to Hammett's rule.

Specific examples of groups represented by $R_1$ and $R_2$ which are electron attractive groups having $\sigma_p$ values of 0.20 or more include, for example, an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with an electron attractive group having $\sigma_p$ of 0.20 or more, a heterocyclic group, a halogen atom, an azo group, and a selenocyanate group. Of these substituents, groups capable of having further substituents may have the substituents given for the groups defined for $R_3$.

To explain $R_1$ and $R_2$ in more detail, specific examples of electron attractive groups having $\sigma_p$ values of 0.20 or more include, for example, an acyl group (for example, acetyl, 3-phenylpropanoyl, benzoyl, and 4-dodecyloxybenzoyl), an acyloxy group (for example, acetoxy), a carbamoyl group (for example, carbamoyl, N-ethylcarbamoyl, N-phenylcarbamoyl, N,N-dibutylcarbamoyl, N-(2-dodecyloxyethyl)carbamoyl, N-(4-n-pentadecanamide)phenylcarbamoyl, N-methyl-N-dodecylcarbamoyl, and N-[3-(2,4-di-t-amylphenoxy)propyl]carbamoyl), an alkoxycarbamoyl group (for example, methoxycarbonyl, ethoxycarbonyl, iso-propyloxycarbonyl, tert-butyloxycarbonyl, iso-butyloxycarbonyl, butyloxycarbonyl, dodecyloxycarbonyl, and octadodecyloxycarbonyl), an aryloxycarbonyl group (for example, phenoxycarbonyl), a cyano group, a nitro group, a dialkylphosphono group (for example, dimethylphosphono), a diarylphosphono group (for example, diphenylphosphono), a diarylphosphinyl group (for example, diphenylphosphinyl), an alkylsulfinyl group (for example, 3-phenoxypropylsulfinyl), an arylsulfinyl group (for example, 3-pentadecylphenylsulfinyl), an alkylsulfonyl group (for example, methanesulfonyl and octanesulfonyl), an arylsulfonyl group (for example, benzenesulfonyl and toluenesulfonyl), a sulfonyloxy group (for example, methanesulfonyloxy and toluenesulfonyloxy), an acylthio group ( for example, acetylthio and benzoylthio), a sulfamoyl group ( for example, N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a thiocyanate group, a thiocarbonyl group (for example, methylthiocarbonyl and phenylthiocarbonyl), a halogenated alkyl group (for example, trifluoromethane and heptafluoropropane), a halogenated alkoxy group (for example, trifluoromethoxy), a halogenated aryloxy group (for example, pentafluorophenyloxy), a halogenated alkylamino group (for example, N,N-di-(trifluoromethyl-)amino), a halogenated alkylthio group (for example, difluoromethyl and 1,1,2,2-tetrafluoroethylthio), an aryl group substituted with an electron attractive group having a $\sigma_p$ of 0.20 or more (for example, 2,4-dinitrophenyl, 2,4,6-trichlorophenyl, and pentachlorophenyl), a heterocyclic group (for example, 2-benzoxazolyl, 2-benzothiazolyl, 1-phenyl-2-benzimidazolyl, 5-chloro-1-tetrazolyl, and 1-pyrrolyl), a halogen atom (for example, a chlorine atom and a bromine atom), an azo group (for example, phenylazo), and a selenocyanato group. Of these substituents, the groups capable of having further substituents may have the substituents given for the groups defined for $R_3$.

Preferred groups represented by $R_1$ and $R_2$ include, for example, an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkoxy group, a halogenated alkylthio group, a halogenated aryloxy group, an aryl group substituted with an electron attractive group having a $\sigma_p$ of 0.20 or more, and a heterocyclic group. More preferred groups include, for example, an aryloxycarbonyl group, an alkoxycarbonyl group, a nitro group, a cyano group, an arylsulfonyl group, a carbamoyl group, and a halogenated alkyl group.

Most preferably, $R_1$ is a cyano group. $R_2$ particularly preferably represents an aryloxycarbonyl group or an alkoxycarbonyl group and most preferably represents a branched alkoxycarbonyl group.

X represents a hydrogen atom or a group capable of splitting off by a coupling reaction with an oxidation product of an aromatic primary amine color developing agent. To explain the group capable of splitting off in detail, examples of such a group include a halogen atom, an alkoxy group, an aryloxy group, an acyloxy group, an alkyl or arylsulfonyloxy group, an acylamino group, an alkyl or arylsulfonamido group, an aryloxycarbonyl group, an alkoxycarbonyloxy group, an aryloxycarbonyloxy group, an alkyl, aryl or heterocyclic thio group, a carbamoylamino group, a 5-membered or 6-membered nitrogen-containing heterocyclic group, an imido group, and an arylazo group. These groups may be further substituted with the groups which are allowed as the substituent for $R_3$.

To be more detailed, examples of suitable splitting off groups as X include a halogen atom (for example, a fluorine atom, a chlorine atom and a bromine atom), an alkoxy group (for example, ethoxy, dodecyloxy, methoxyethylcarbamoylmethoxy, carboxypropyloxy, methylsulfonylethoxy, and ethoxycarbonylmethoxy ), an aryloxy group (for example, 4-methylphenoxy, 4-chlorophenoxy, 4-methoxyphenoxy, 4-carboxyphenoxy, 3-ethoxycarboxyphenoxy, 3-acetylaminophenoxy, and 2-carboxyphenoxy), an acyloxy group (for example, acetoxy, tetradecanoyloxy, and benzoyloxy), an alkyl or arylsulfonyloxy group (for example, methanesulfonyloxy and toluenesulfonyloxy), an acylamino group (for example, dichloroacetylamino and heptafluorobutylylamino), an alkyl or arylsulfonamido group (for example, methanesulfonamido, trifluoromethanesulfonamido, and p-toluenesulfonylamino), an alkoxycarbonyloxy group (for example, ethoxycarbonyloxy and benzyloxycarbonyloxy), an aryloxycarbonyloxy group (for example, phenoxycarbonyloxy), an alkyl, aryl or heterocyclic thio group (for example, dodecylthio, 1-carboxydodecylthio, phenylthio, 2-butoxy-5-t-octylphenylthio, and tetrazolylthio), a carbamoylamino group (for example, N-methylcarbamoylamino and N-phenylcarbamoylamino), a 5-membered or 6-membered nitrogen-containing heterocyclic group (for example, imidazolyl, pyrazolyl, triazolyl, tetrazolyl, and 1,2-dihydro-2-oxo1-pyridyl), an imido group (for example, succinimide and hydantoinyl), and an arylazo group (for example, phenylazo and 4-methoxyphenylazo). In addition to the above groups, X may be in the form of a splitting group having a bond via a carbon atom in a bis type coupler in some cases, which can be obtained by condensing a 4-equivalent coupler with aldehydes and ketones. Further, X may contain photographically useful groups such as a development inhibitor and a development accelerator.

X is preferably a halogen atom, an alkoxy group, an aryloxy group, an alkyl or arylthio group, or a 5-membered or 6-membered nitrogen-containing heterocyclic group bonded to an active coupling site via the nitrogen atom. X is more preferably a halogen atom, or an alkyl or arylthio group. An arylthio group is particularly preferred.

In the cyan coupler represented by Formula (I) or (II), the group represented by $R_1$, $R_2$, $R_3$ or X may be a divalent group and combine with a dimer or a polymer which is higher than a dimer and which has a high molecular weight chain to form a homopolymer or a copolymer. A typical example of a homopolymer or copolymer formed by combining with a high molecular chain includes a homopolymer or copolymer of an addition polymer, and ethylenically unsaturated compound or copolymer thereof which has a cyan coupler group represented by Formula (I) or (II). In this case, one or more kinds of a cyan color development repeating unit having a cyan coupler group represented by Formula (I) or (II) may be contained in the polymer and one or more kinds of a non-color developable ethylene type monomer may be contained therein as a copolymerization component. The cyan color development repeating unit having a cyan coupler group represented by Formula (I) or (II) is preferably represented by the following Formula (P):

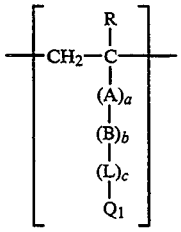

(P)

wherein R represents a hydrogen atom, an alkyl group having 1 to 4 carbon atoms, or a chlorine atom; A represents —CONH—, —COO—, or a substituted or unsubstituted phenylene group; B represents a substituted or unsubstituted alkylene group, phenylene group or alkylene group; L represents —CONH—, —NHCONH—, —NHCOO—, —NHCO—, —OCONH—, —NH—, —COO—, —OCO—, —CO—, —O—, —S—, —$SO_2$—, —$NHSO_2$—, or —$SO_2NH$—; a, b and c each represents 0 and 1; and $Q_1$ represents a cyan coupler group formed by having a hydrogen atom split off from $R_1$, $R_2$, $R_3$ or X in the compound represented by Formula (I) or (II).

A preferred polymer is a copolymer of a cyan color developing monomer represented by a coupler group of Formula (I) or (II) and a non-color developable ethylene type monomer which is not capable of coupling with an oxidation product of an aromatic primary amine developing agent.

Suitable non-color developable ethylene type monomers which are not capable of coupling with an oxidation product of an aromatic primary amine developing agent include, for example, acrylic acid, α-chloroacrylic acid, α-alkylacrylic acid (for example, methacrylic acid), an amide or ester derived from these acrylic acids (for example, acrylamide, methacrylamide, n-butylacrylamide, t-butylacrylamide, diacetone acrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxy methacrylate), a vinyl ester (for example, vinyl acetate, vinyl propionate, and vinyl laurate), acrylonitrile, methacrylonitrile, an aromatic vinyl compound (for example, styrene and derivatives thereof, for example, vinyl toluene, divinylbenzene, vinyl acetophenone, and sulfostyrene), itaconic acid, citraconic acid, crotonic acid, vinylidene chloride, vinyl alkyl ether (for example, vinyl ethyl ether), maleic acid ester, N-vinyl-2-pyrrolidone, N-vinylpyridine, and 2- and 4-vinylpyridines.

Particularly preferred non-color developable ethylene type monomers are acrylic acid ester, methacrylic acid ester, and maleic acid ester. The non-color developable ethylene type monomer used herewith can be used in combination of two or more kinds of monomers. For example, it is suitable to use, in combination, methyl methacrylate and butyl acrylate, butyl acrylate and styrene, butyl methacrylate and methacrylic acid, and methyl acrylate and diacetone acrylamide.

As is known in the polymer coupler art, the ethylene type unsaturated monomer which can be copolymerized with the vinyl type monomer (P) corresponding to the compound represented by Formula (I) or (II) can be selected so that the physical properties and/or chemical properties of the copolymer formed, for example, solubility, compatibility with a binder for a photographic colloid composition, such as gelatin, and flexibility and thermal stability thereof, are favorably affected.

In order to incorporate the cyan coupler of the present invention into a silver halide photographic material, preferably a red-sensitive silver halide emulsion layer, the cyan coupler is preferably converted to an inner type coupler. For this purpose, at least one of the groups represented by $R_1$, $R_2$, $R_3$ and X is preferably a so-called ballast group (preferably having 10 or more total carbon atoms, more preferably 10 to 50 total carbon atoms). In particular, $R_3$ is preferably the ballast group.

In the present invention, the cyan coupler represented by Formula (I), particularly the cyan coupler represented by Formula (I-a), is preferred in terms of the effect thereof.

Specific examples of cyan couplers of the present invention are shown below but the present invention is not limited thereto.

(1)
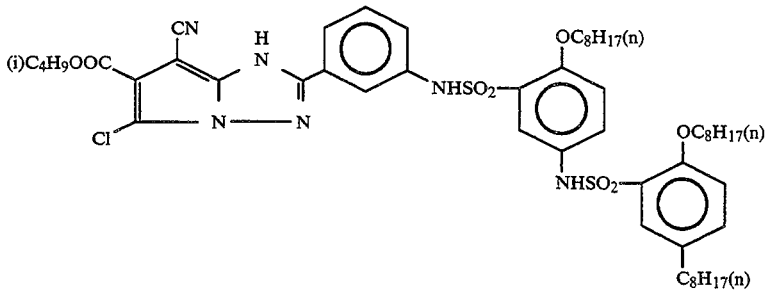
(2)
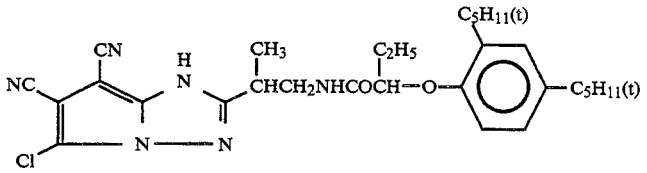
(3)
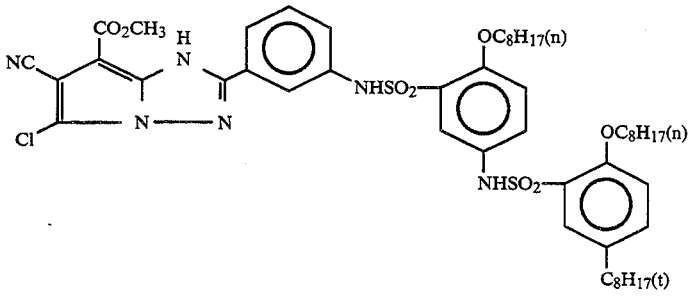
(4)
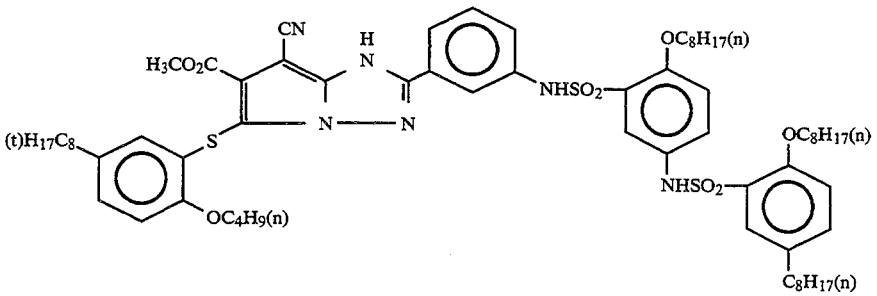
(5)
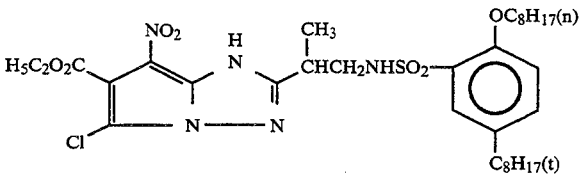
(6)
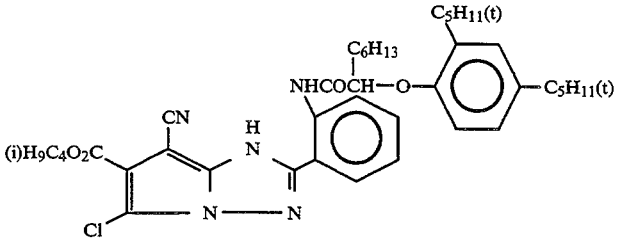

-continued
(7)
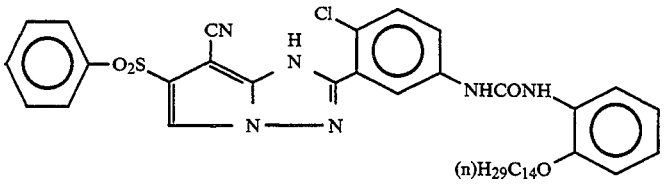
(8)
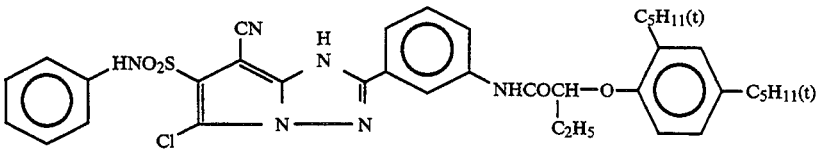
(9)
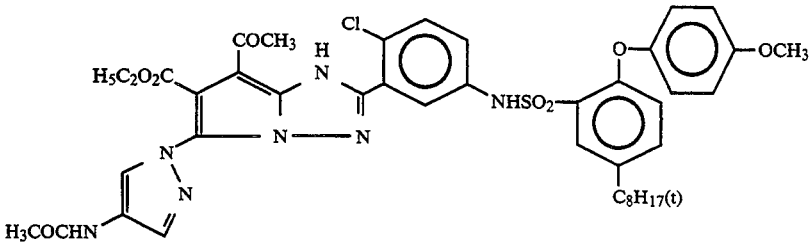
(10)
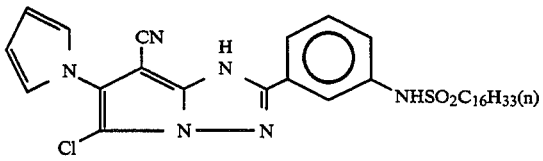
(11)
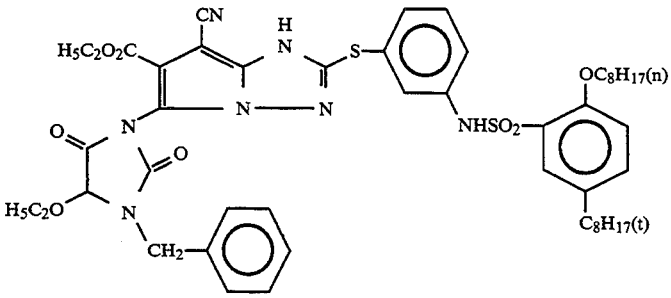
(12)
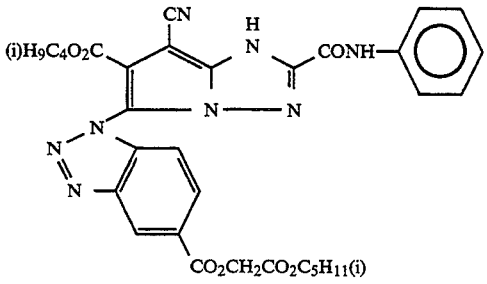
(13)
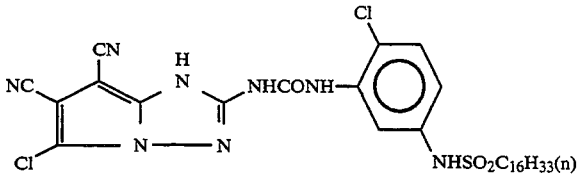

-continued
(14)
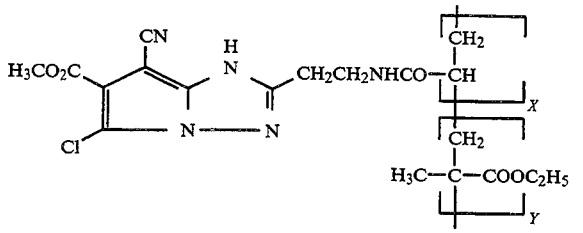
X:Y = 50:50
(by weight)
(15)
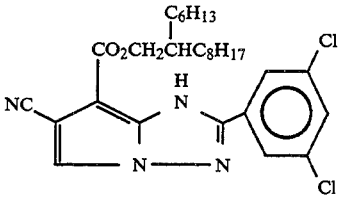
(16)
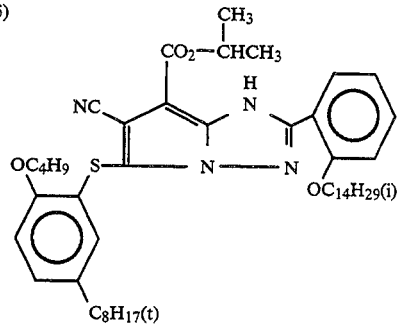
(17)
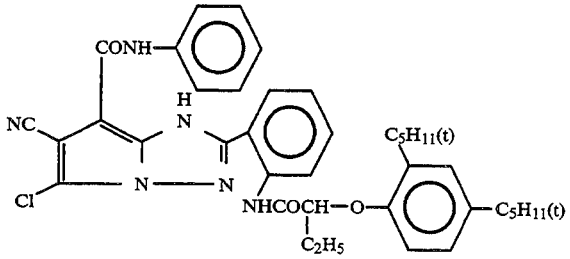
(18)
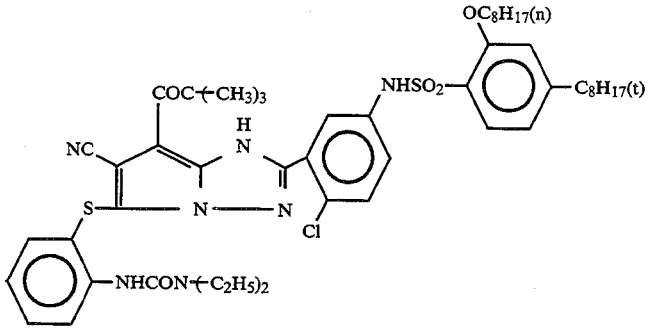
(19)
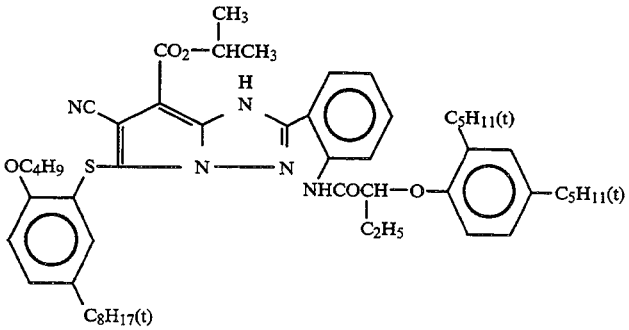

-continued
(20)
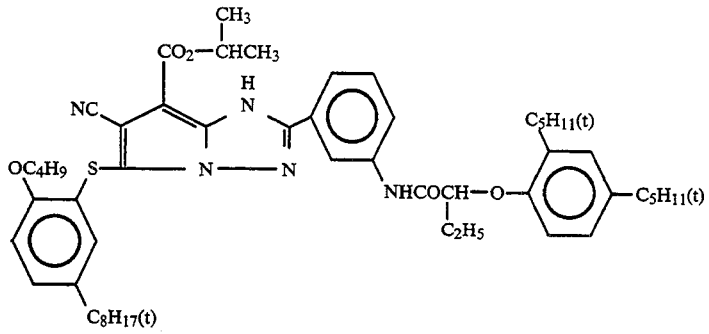
(21)
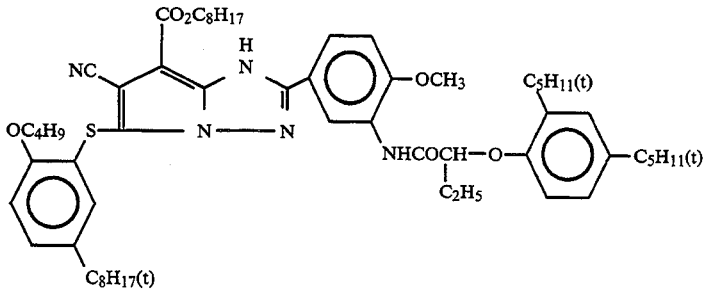
(22)
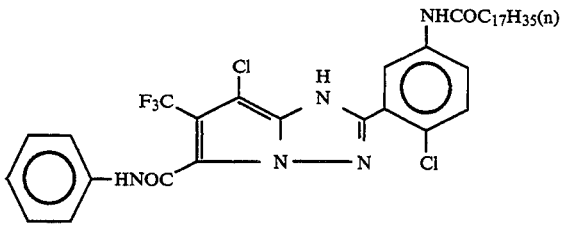
(23)
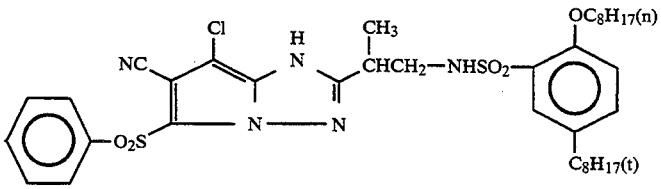
(24)
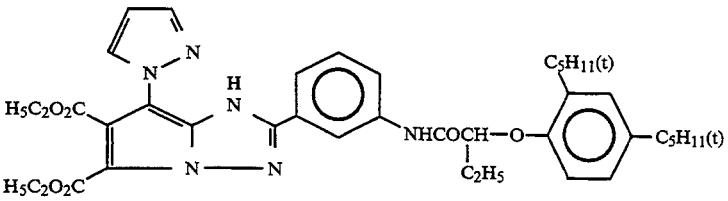
(25)
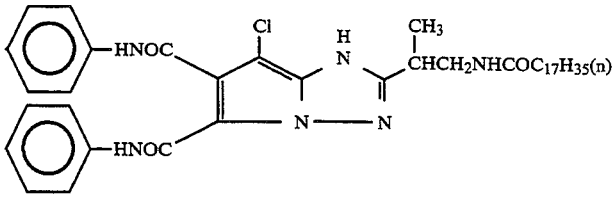

-continued
(26)
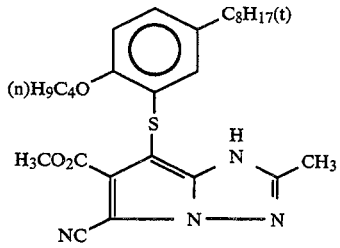
(27)
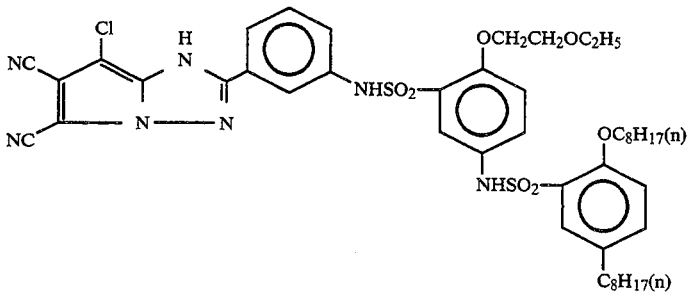
(28)
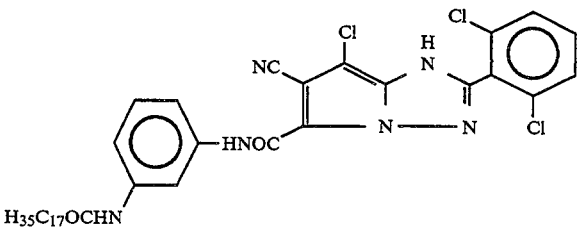
(29)
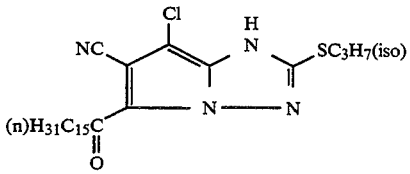
(30)
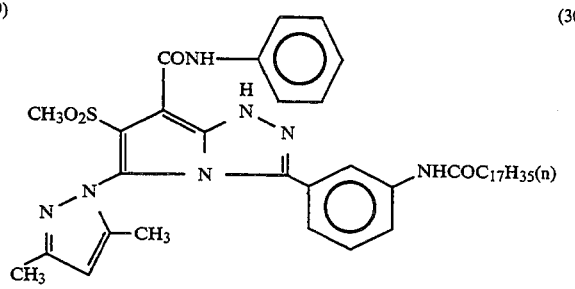
(31)
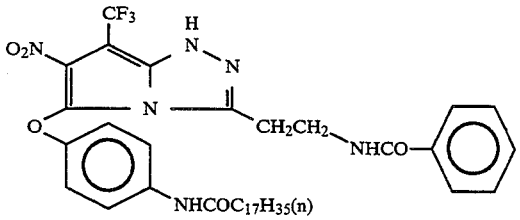
(32)
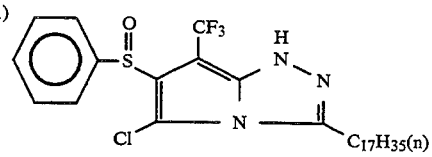
(33)
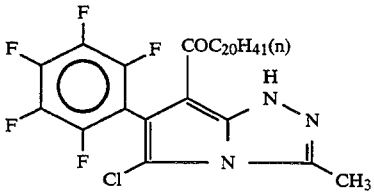
(34)
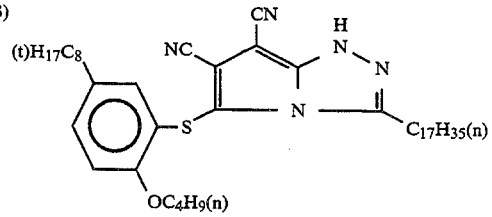

-continued
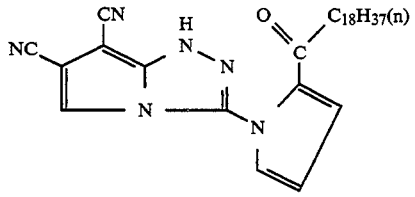
(35)
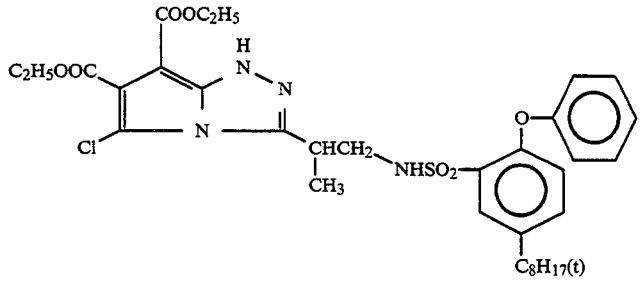
(36)
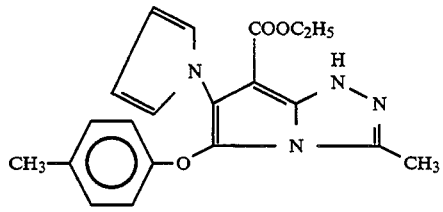
(37)
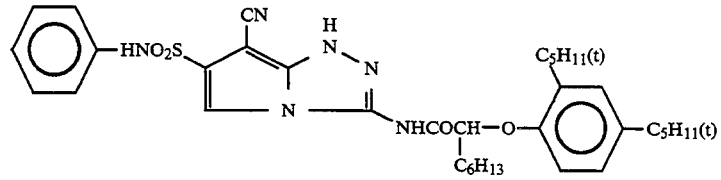
(38)
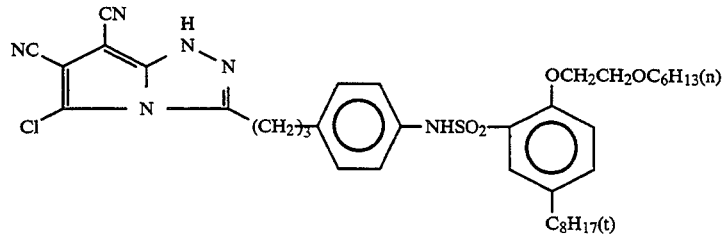
(39)
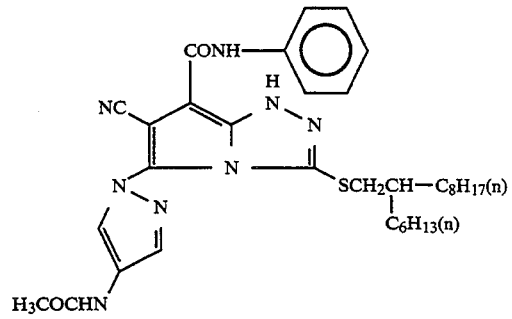
(40)

-continued
(41)
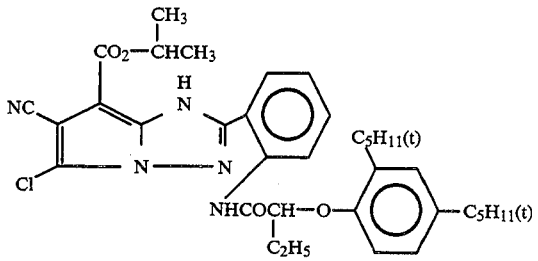
(42)
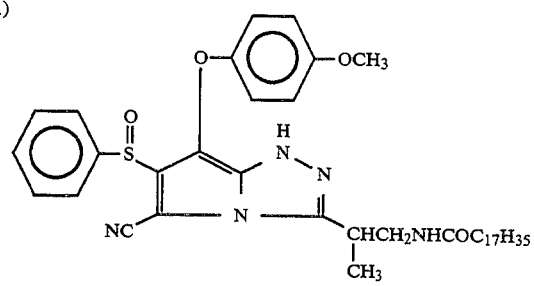
(43)
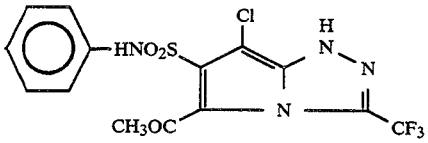
(44)
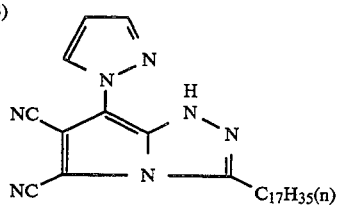
(45)
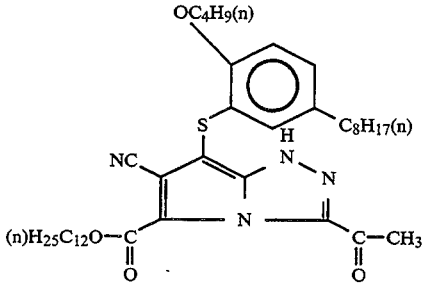
(46)
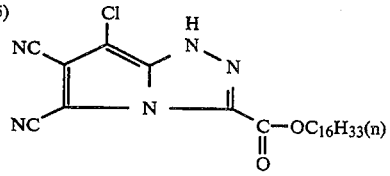
(47)
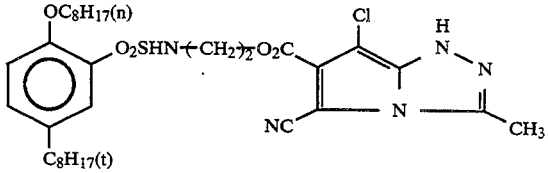
(48)
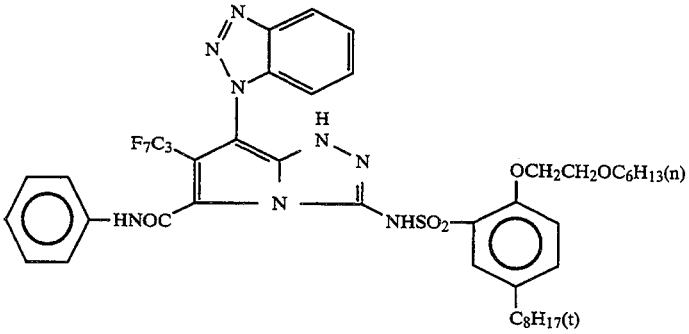
(49)
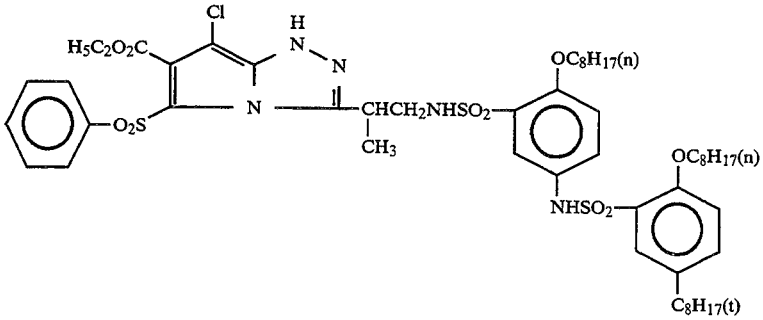

-continued
(50)
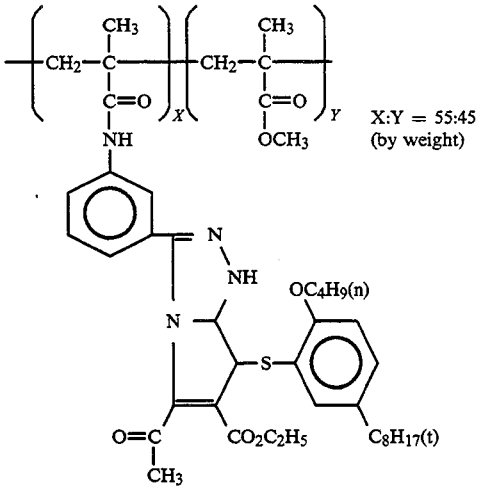
(51)
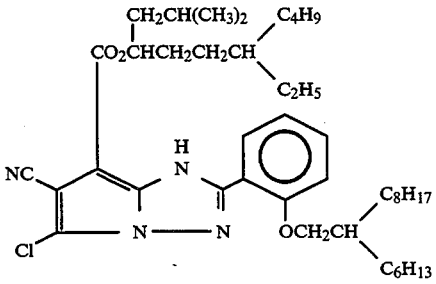
(52)
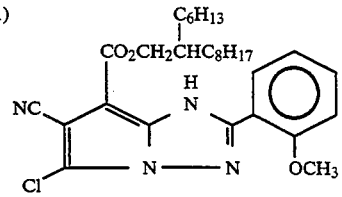
(53)
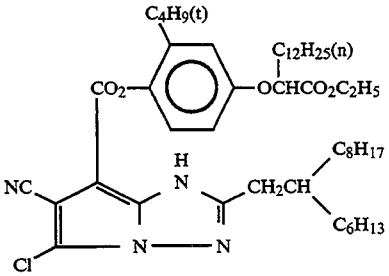
(54)
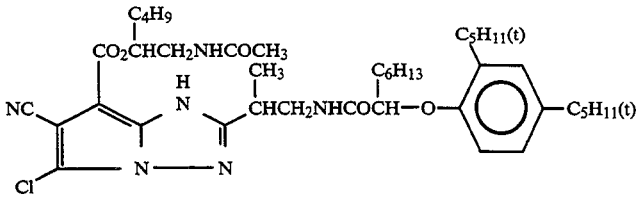
(55)
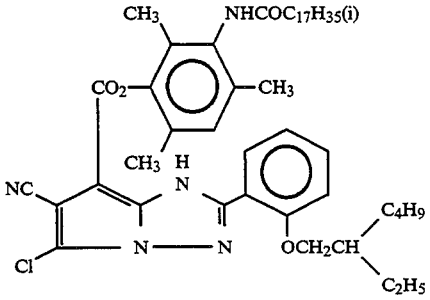

-continued

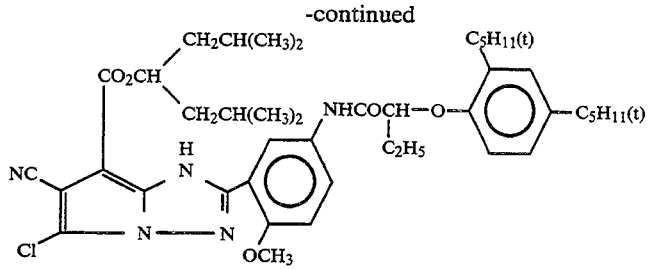

(56)

Next, synthesis examples for cyan couplers of the present invention will be shown in order to explain the synthesis method thereof.

Synthesis Example 1 (Synthesis of Compound (1))

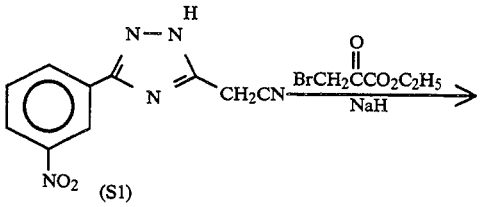

(S1)

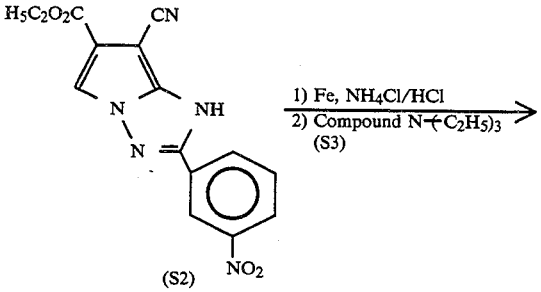

(S2)

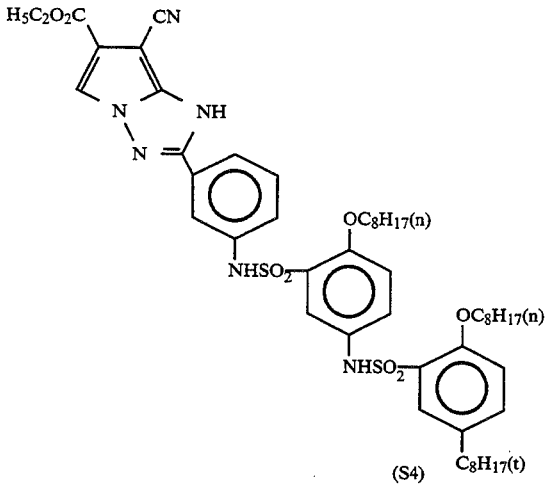

(S4)

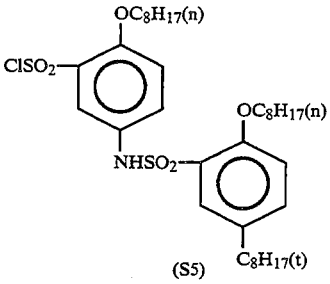

(S5)

-continued

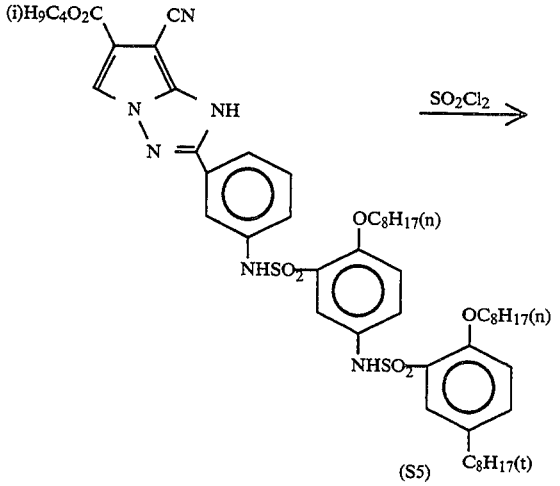

(S5)

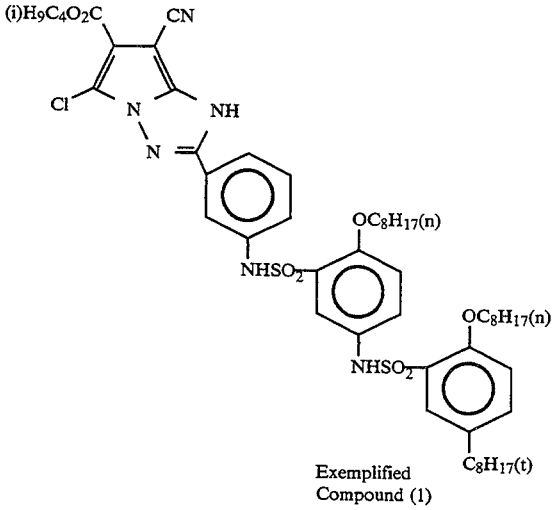

Exemplified Compound (1)

20.0 g (87.3 mmol) of 3-m-nitrophenyl-5-methylcyano-1,2,4-triazole (compound (S1)) were dissolved in dimethylacetamide (150 ml), and NaH (60% in oil) (7.3 g, 183 mmol) was added thereto little by little, followed by heating to 80° C. A 50% dimethylacetamide solution (50 ml) containing ethyl piruvate (13.1 ml, 105 mmol) was slowly added drop-wise to the above solution. The resulting reaction solution was stirred at 80° C. for 30 minutes after completing the dropwise addition, and then the solution was cooled down to room temperature. Hydrochloric acid 1N then was added to the cooled reaction solution to make it acid, and then the solution was extracted with ethyl acetate. After drying on sodium sulfate, the solvent was distilled off under a reduced pressure. The residue was refined with silica gel chromatography to obtain compound (S2) (10.79 g) (38% yield).

Reduced iron (9.26 g, 166 mmol) and ammonium chloride (0.89 g, 16.6 mmol) were suspended in isopropanol (300 ml) and then, water (30 ml) and concentrated hydrochloric acid (2 ml) were further added and the resulting solution was heated at refluxing for 30 minutes. Compound (S2) (10.79 g, 33.2 mmol) was added little by little while heating for refluxing. After heating at refluxing for an additional 4 hours, the solution was immediately filtered with celite and the filtrate was subjected to a distillation under a reduced pressure. The residue was dissolved in a mixed solvent of dimethylacetamide (40 ml) and ethyl acetate (60 ml), and compound (S3) (25.6 g, 36.5 mmol) was added thereto. Then, triethylamine (23.1 ml, 166 mmol) was added and the solution was heated at 70° C. for 5 hours. After the reaction solution was cooled down to room temperature, water was added thereto and the solution was extracted with ethyl acetate. After the extract was washed with water, it was dried on sodium sulfate and the solvent was distilled off under a reduced pressure. The residue was refined with silica gel chromatography to obtain compound (S4): (16.5 g) (52% yield).

Compound (S4) (7.0 g, 7.30 mmol) was dissolved in isobutanol (14 ml) and tetraisopropyl orthotitanate (0.43 ml, 1.46 mmol) was added, followed by heating at refluxing for 6 hours. After the reaction solution was cooled down to room temperature, water was added thereto and the solution was extracted with ethyl acetate. The extract was dried on sodium sulfate and the solvent was distilled off under a reduced pressure. The residue was refined with silica gel chromatography to obtain compound (S5): (5.0 g) (69% yield).

Compound (S5) (5.0 g, 5.04 mmol) was dissolved in tetrahydrofuran (50 ml) and SO2Cl (0.40 ml, 5.04 mmol) was added drop-wise while cooling with water. After completing the drop-wise addition, the solution was stirred for an additional 4 hours while cooling with water. Water was added to the reaction solution and the solution was extracted with ethyl acetate. The extract was dried on sodium sulfate and the solvent was distilled off under a reduced pressure. The residue was refined with silica gel chromatography to obtain the exemplified Compound (1): (3.9 g) (76% yield).

Synthesis Example 2 (Synthesis of Exemplified Compound (39))

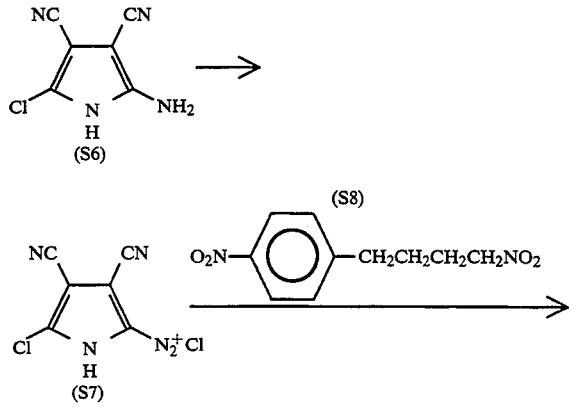

-continued

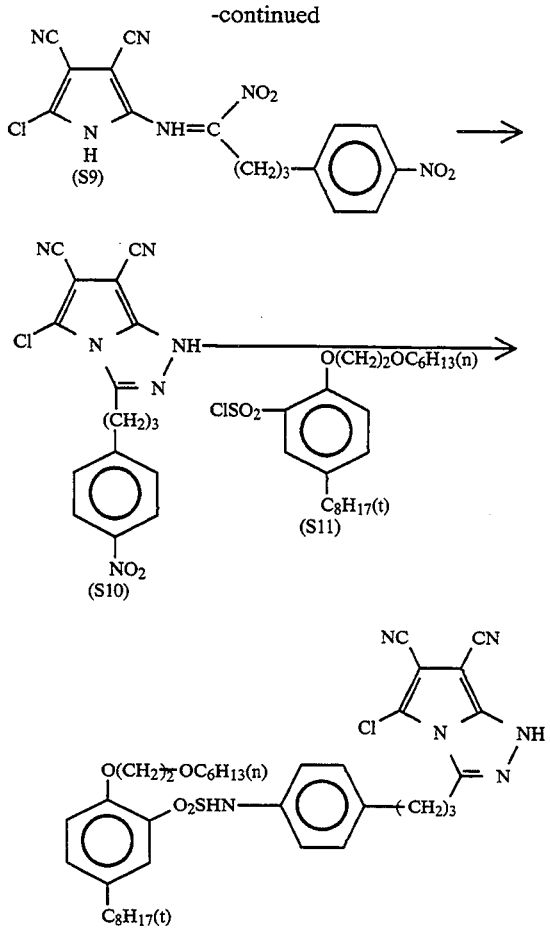

Exemplified Compound (39)

Hydrochloric acid (36%) (38 ml) was added to 2-amino-5-chloro-3,4-dicyanopyrrole (Compound (S6)) (6.78 g, 40.7 mmol), and an aqueous solution (5.9 ml) of sodium sulfite (2.95 g, 42.7 mmol) was slowly added drop-wise while stirring and cooling with ice, followed by continuing the stirring for 1.5 hours, whereby compound (S7) was prepared. While stirring and cooling with ice, the compound (S7) thus prepared was slowly added drop-wise to a solution prepared by adding sodium methylate (28%) (102 ml) to an ethanol solution (177 ml) of compound (S8) (9.58 g, 427 mmol) while stirring and cooling with ice, and then the stirring was continued for 1 hour. Next, the reaction solution was heated at refluxing for 1.5 hours. Then, methanol was distilled off from the reaction solution under a reduced pressure, and the residue was dissolved in chloroform. The solution thus prepared was washed with a saturated brine, and after drying on sodium sulfate, chloroform was distilled off under a reduced pressure. The residue was refined with silica gel chromatography to obtain the compound (S10): (4.19 g) (the yield from compounds (S6) through (S10): 29%).

Compound (S6) was synthesized as illustrated below by subjecting 3,4-dicyanopyrrole to a nitration and a reduction with iron after chlorination. Also, compound (S8) was synthesized as illustrated below from compound (a) according to the method described in *Journal of the American Chemical Society*, 76, pp. 3209 (1954), the compound (a) being synthesized from g-lactone and benzene by a known method.

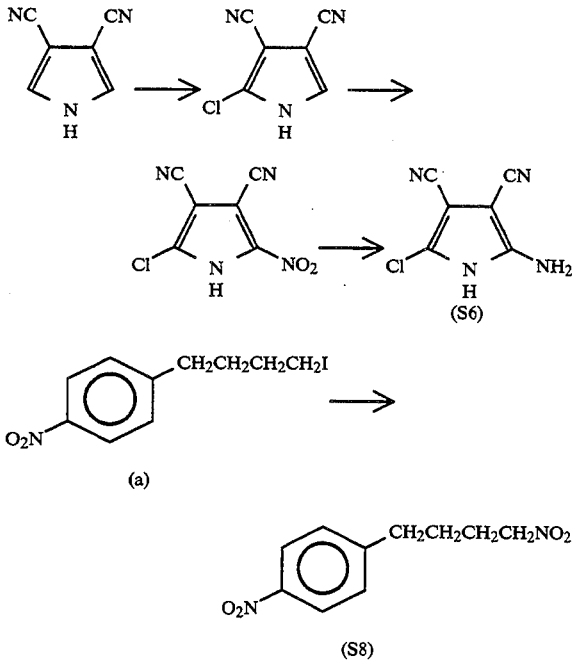

Water (10 ml), ammonium chloride (0.3 g, 5.9 mmol) and acetic acid (0.34 ml, 5.9 mmol) were added to reduced iron powder (3.3 g, 59.0 mmol), and the solution thus prepared was heated for refluxing for 15 minutes while stirring. Then, isopropanol (31 ml) was added thereto and the solution was heated at refluxing for an additional 20 minutes while stirring. Next, an isopropanol solution (14 ml) of compound (S10) (4.1 g, 11.8 mmol) was added drop-wise and the resulting reaction solution was heated at refluxing for 2 hours. Then, the reaction solution was filtered using celite as a filter aid and the substance remaining on the filter was washed with ethyl acetate, followed by distilling off the solvent under a reduced pressure.

The residue was dissolved in a mixed solvent of ethyl acetate (16 ml) and dimethylacetamide (24 ml). There were added thereto compound (S11) (5.6 g, 13.0 mmol) and then triethylamine (8.2 ml, 59.0 mmol), and the resulting solution was stirred at room temperature for 4 hours. Water was added thereto and the solution was extracted with ethyl acetate, followed by washing the extract with a saturated brine. After drying on sodium sulfate, the solvent was distilled off under a reduced pressure and the residue was refined with silica gel chromatography, whereby the exemplified Compound (39) (6.46 g) (76% yield) was obtained.

Next, the cyan coupler, that is, the phenol type cyan coupler, represented by Formula (III) or (IV) will be explained below in detail.

In the above Formulas (III) and (IV), $R_{11}$ preferably is a linear, branched or cyclic alkyl group having a total number of carbon atoms (hereinafter referred to as the C number) of 1 to 36 (preferably 1 to 24) and which can be substituted, an aryl group having a C number of 6 to 36 (preferably 6 to 24) and which can be substituted, or a heterocyclic group having a C number of 2 to 36 (preferably 2 to 24) and which can be substituted, wherein the heterocyclic group is a 5 to 7-membered heterocyclic group having at least one hetero atom selected from N, O, S, P, Se and Te and which can be condensed, and suitable examples include, for example, 2-furyl, 2-thienyl, 4-pyridyl, 2-imidazolyl, and 4-quinolyl. Suitable substituents for $R_{11}$ include, for example, a halogen atom, a cyano group, a nitro group, a carboxyl group, a sulfo group, an alkyl group, an aryl group, a heterocyclic group, an alkoxy group, an aryloxy group, an alkylthio group, an arylthio group, an alkylsulfonyl group, an arylsulfonyl group, an alkoxycarbonyl group, an aryloxycarbonyl group, an acyl group, a carbonamido group, a sulfonamido group, a carbamoyl group, a sulfamoyl group, a ureido group, an alkoxycarbonylamino group, and a sulfamoylamino group (hereinafter referred to as the substituent group A). Preferred substituents include, for example, a halogen atom (F, Cl, Br and I), a cyano group, an alkyl group, an aryloxy group, an alkylsulfonyl group, an arylsulfonyl group, a carbonamido group, and a sulfonamido group.

In the above Formula (III), $R_{11}$ is preferably an alkyl group, and in the above Formula (IV), $R_{12}$ is preferably an alkyl group or an aryl group.

In the above Formula (III), $R_{12}$ preferably is a linear, branched or cyclic alkyl group having a C number of 2 to 36. More preferably, $R_{12}$ is an alkyl group having a C number of 2 to 8 (for example, ethyl, propyl, isopropyl, t-butyl, and cyclopentyl).

In the above Formula (III) or (IV), $R_{13}$ preferably is a hydrogen atom, a halogen atom (F, Cl, Br and I), a linear, branched or cyclic alkyl group having a C number of 1 to 16 (preferably 1 to 8), an aryl group having a C number of 6 to 24 (preferably 6 to 12), an alkoxy group having a C number of 1 to 24 (preferably 1 to 8), an aryloxy group having a C number of 6 to 24 (preferably 6 to 12), a carbonamido group having a C number of 1 to 24 (preferably 2 to 12), or a ureido group having a C number of 1 to 24 (preferably 1 to 12), wherein when $R_{13}$ is an alkyl group, an aryl group, an alkoxy group, an aryloxy group, a carbonamido group, or a ureido group, it may be substituted with a substituent selected from the above substituent group A.

In the above Formula (III), $R_{13}$ is preferably a halogen atom, and in the above Formula (IV), $R_{13}$ is preferably a hydrogen atom, a halogen atom, an alkoxy group, or a carbonamido group, particularly preferably a hydrogen atom.

In the above Formula (III), $R_{12}$ and $R_{13}$ may be combined with each other to form a ring. Also, in Formula (IV), $R_{13}$ and $R_{14}$ may be combined with each other to form a ring, in which $R_{13}$ may be a single bond or an imino group.

In the above Formula (IV), $R_{14}$ may be an $R_{11}$ group, an alkoxy group having a C number of 1 to 36 (preferably 1 to 24), an aryloxy group having a C number of 6 to 36 (preferably 6 to 24), or an alkyl or aryl-substituted amino group having a C number of 1 to 36 (preferably 1 to 24). $R_{14}$ is preferably an $R_{11}$ group, and is more preferably an alkyl group.

In the above Formula (III) or (IV), X' represents a hydrogen atom or a coupling splitting-off group capable of splitting off upon reaction with an oxidation product of an aromatic primary amine developing agent. Examples of suitable coupling splitting-off groups include a halogen atom (F, Cl, Br and I), a sulfo group, an alkoxy group having a C number of 1 to 36 (preferably 1 to 24), an aryloxy group having a C number of 6 to 36 (preferably 6 to 24), an acyloxy group having a C number of 2 to 36 (preferably 2 to 24), an alkyl or arylsulfonyloxy group having a C number of 1 to 36 (preferably 1 to 24), an alkylthio group having a C number of 1 to 36 (preferably 1 to 24), an arylthio group having a C number of 6 to 36 (preferably 6 to 24), an imido group having a C number of 4 to 36 (preferably 4 to 24), a carbamoyloxy group having a C number of 1 to 36 (preferably 1 to 24), and a heterocyclic group having a C number of 1 to 36 (preferably 2 to 24), which is combined to a coupling active site via a nitrogen atom, (for example, tetrazole-5-yl, pyrazolyl, imidazolyl, and 1,2,4-triazole-l-yl), wherein the groups following the alkoxy group may be substituted with the groups selected from the above substituent group A. X' is preferably a hydrogen atom, a fluorine atom, a chlorine atom, a sulfo group, an alkoxy group, or an aryloxy group, and is particularly preferably a hydrogen atom or a chlorine atom.

In the above Formulas (III) and (IV), n is an integer of 0 or 1, preferably 1.

Examples of the respective substituents in Formulas (III) and (IV) are shown below.

Examples of $R_{11}$ are shown below:

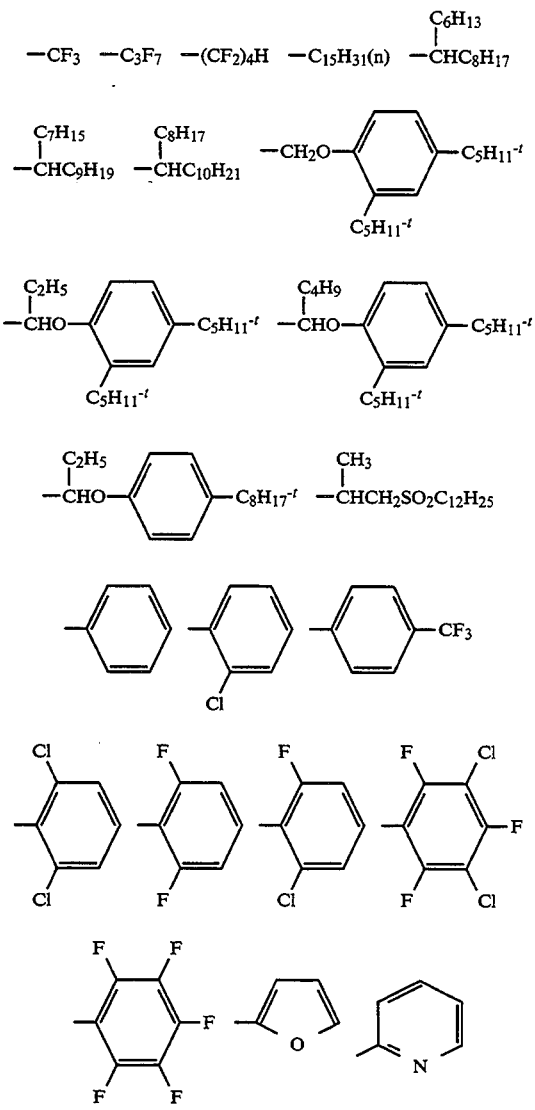

-continued

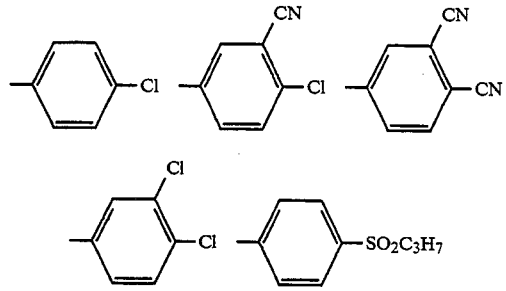

Examples of $R_{12}$ are shown below

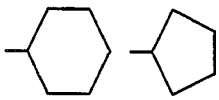

Examples of $R_{13}$ are shown below:

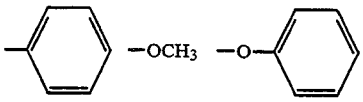

Examples of $R_{14}$ are shown below:

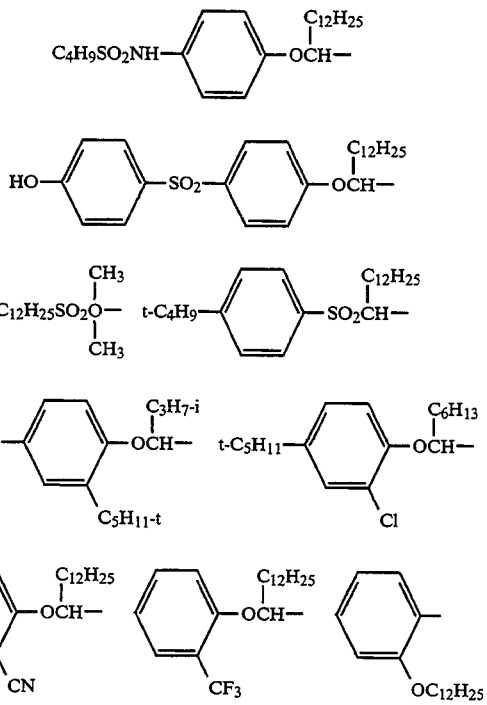

Examples of X' are shown below:

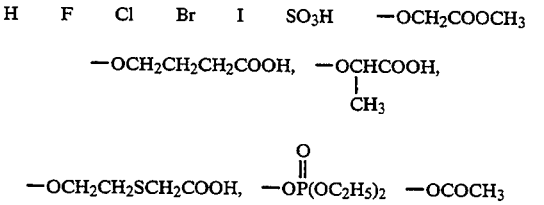

-continued
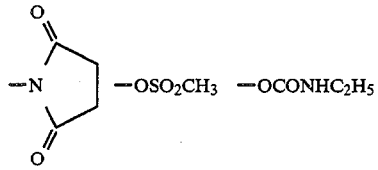
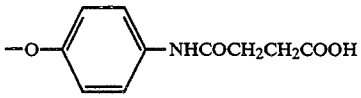
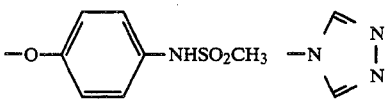
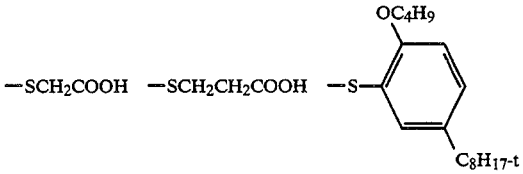
Specific examples of cyan couplers represented by Formula (III) are shown below:
1C-1
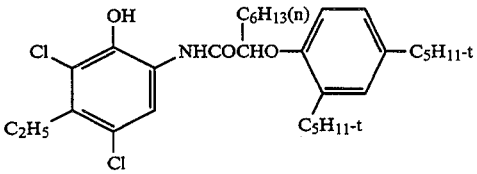
1C-2
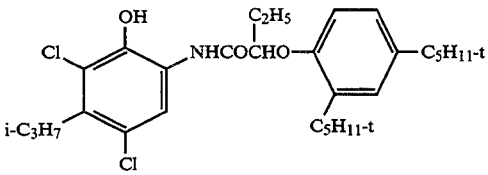
1C-3
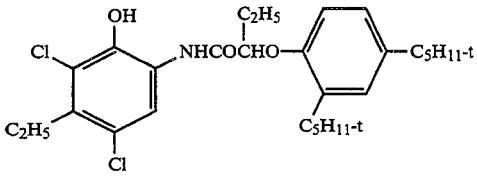
1C-4
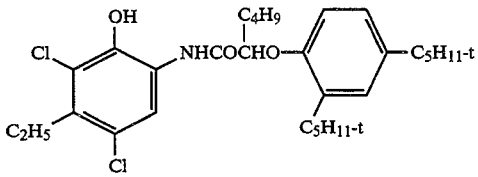
-continued
1C-5
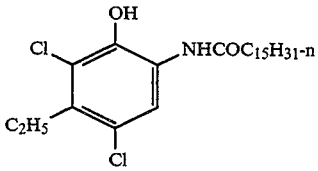
1C-6
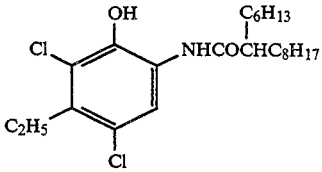
1C-7
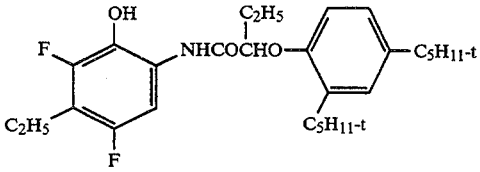
1C-8
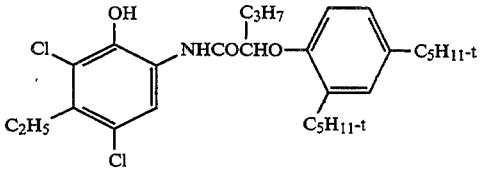
1C-9
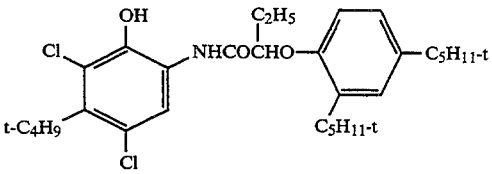
1C-10
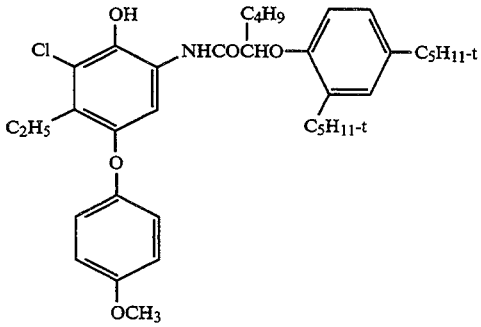
Specific examples of cyan couplers represented by Formula (IV) are shown below:

2C-11
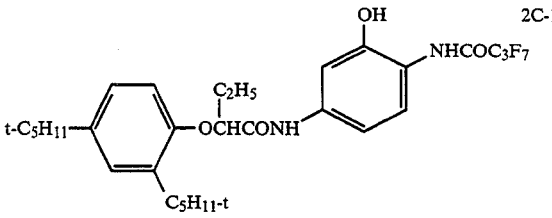
2C-12
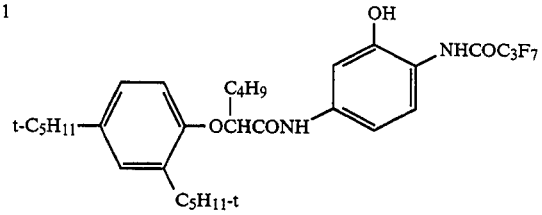
2C-13
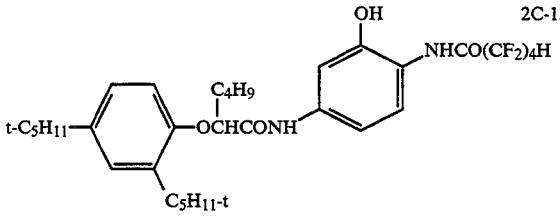
2C-14
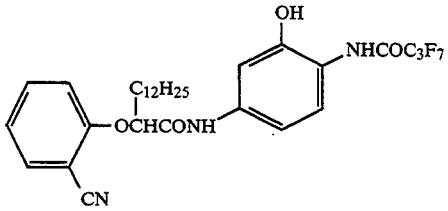
2C-15
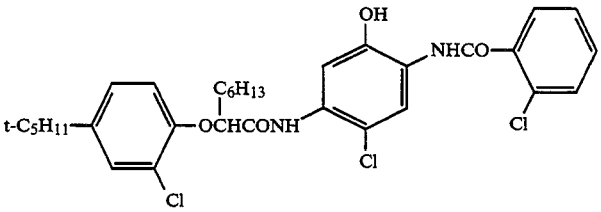
2C-16
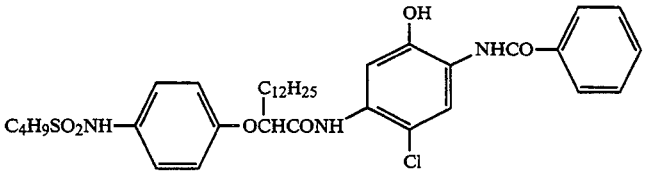
2C-17
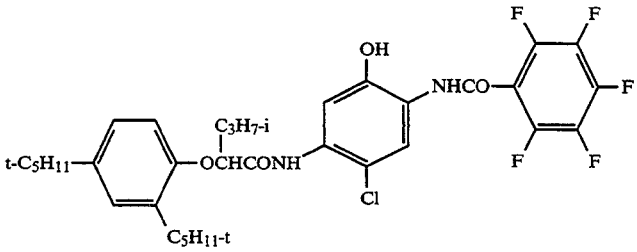
2C-18
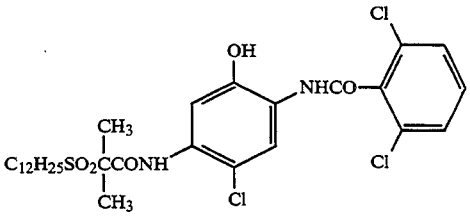
2C-19
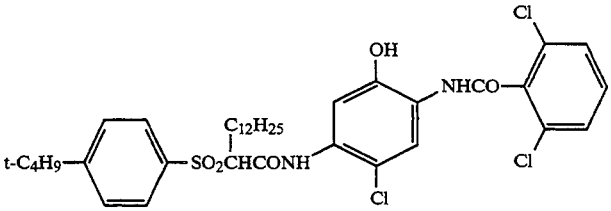

-continued
2C-20
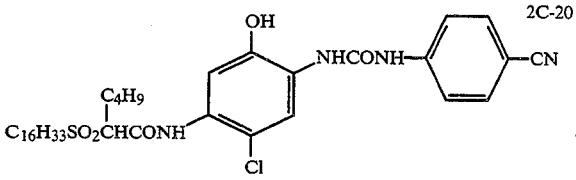
2C-21
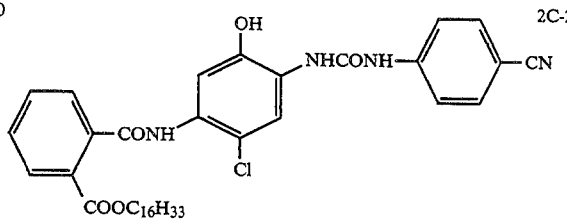
2C-22
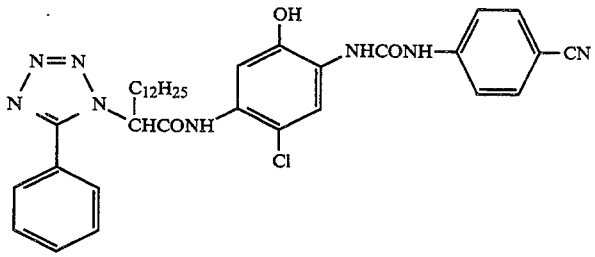
2C-23
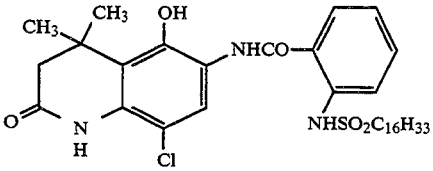
2C-24
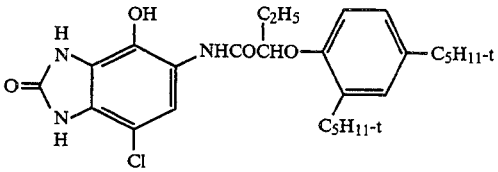
2C-25
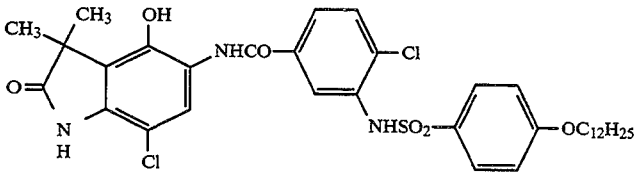
2C-26
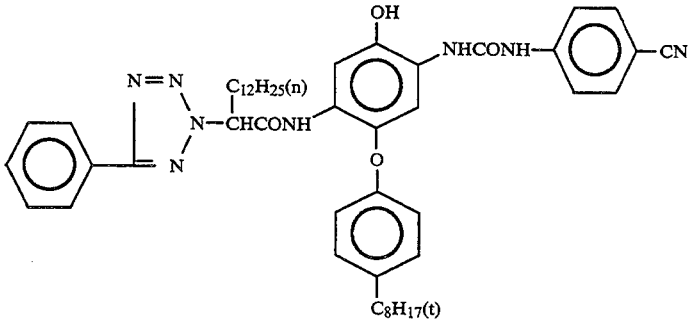
2C-27
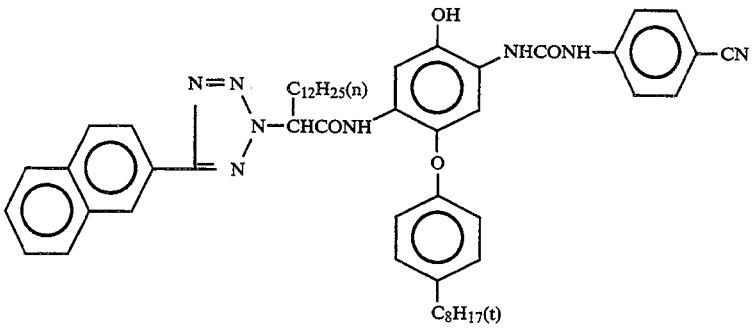

-continued 2C-28

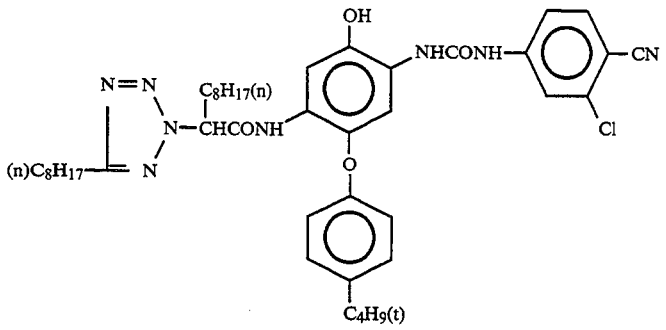

2C-29

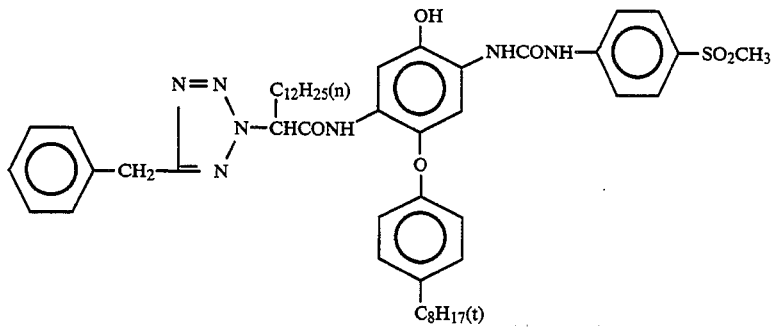

2C-30

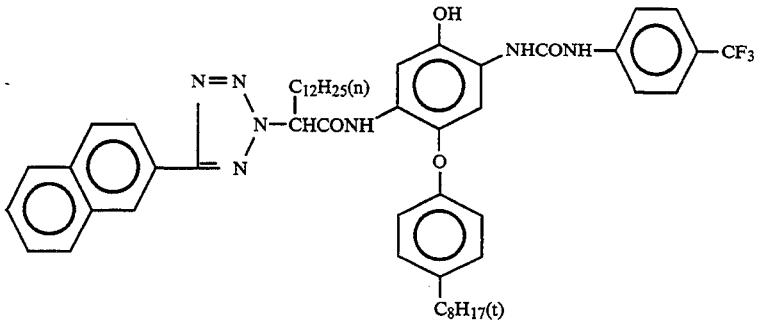

Additional specific examples of couplers of Formulas (III) and ( IV ) and synthesis methods for such cyan couplers are described in U.S. Pat. Nos. 2,369,929, 2,772,162, 2,895,826, 3,772,002, 4,327,173, 4,333,999, 4,334,011, 4,430,423, 4,500,635, 4,518,687, 4,564,586, 4,609,619, 4,686,177, and 4,746,602, and JP-A-59-164555.

Next, the 1-naphthol type cyan couplers represented by Formulas (V) and (VI) will be described in detail.

The 1 -naphthol type cyan couplers of Formulas (V) and ( VI ) may be represented by the following Formulas (3-1a), (3-2a), (3-1b), (3-2b), (3-1c) and (3-2c):

(3-1a)

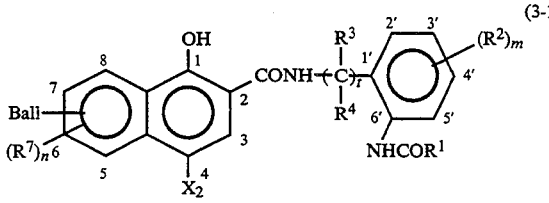

-continued (3-2a)

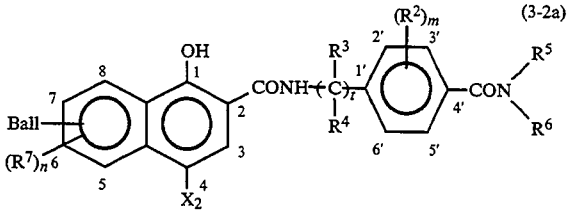

wherein $R^1$ represents a hydrogen atom, an alkyl group, an alkenyl group, an alkynyl group, a cycloalkyl group, an aralkyl group, an alkoxy group, an amino group, or an aryl group; $R^2$ represents a substituent group; $R^3$ and $R^4$ each represents a hydrogen atom, an alkyl group, an aryl group, a halogen atom, an alkoxy group, or an aryloxy group; $R^5$ and $R^6$ each represents a hydrogen atom, an alkyl group, or an aryl group; $R^7$ represents a substituent group; Ball represents a ballast group; $X_2$ represents a hydrogen atom or a coupling splitting-off group; t, m and n each represents an integer of 0 to 4;

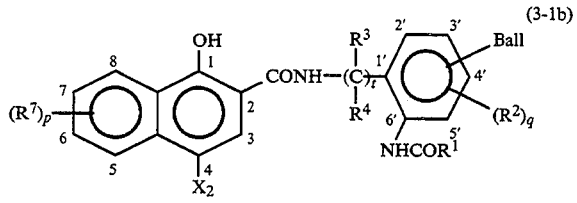

(3-1b)

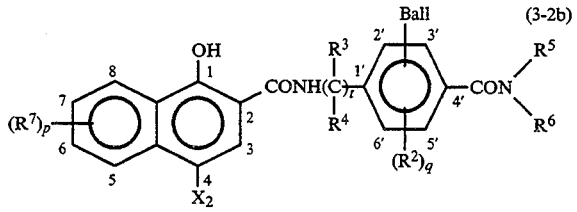

(3-2b)

wherein $R^1$, $R^2$, $R^3$, $R^4$, $R^5$, $R^6$, $R^7$ Ball t and $X_2$ have the same meanings as $R^1$, $R^2$, $R^3$, $R^4$, $R^5$, $R^6$, $R_7$ Ball t and $X_2$ in Formulas (3-1a) and (3-1b), respectively; q represents an integer of 0 to 3; and p represents an integer of 0 to 5;

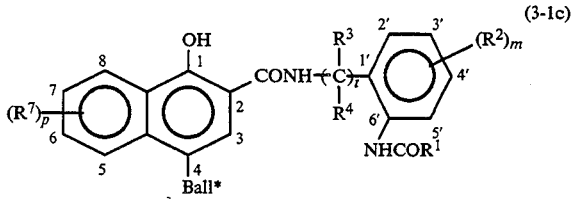

(3-1c)

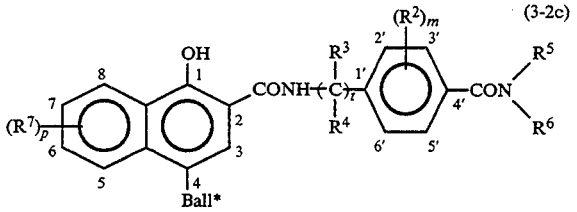

(3-2c)

wherein $R^1$, $R^2$, $R^3$, $R^4$, $R^5$, $R_6$, $R_7$, t, m and p have the same meanings as $R^1$, $R^2$, $R^3$, $R^4$, $R^5$, $R^6$, $R_7$, t, m and p in Formulas (3-1a), (3-1b), (3-1b) and (3-2b), respectively; and Ball* represents a coupling splitting-off group which is a ballast group.

In Formulas (3-1a), (3-1b) and (3-1c), $R^1$ preferably represents a hydrogen atom, an alkyl group having a C number of 1 to 8 (preferably 1 to 3) (for example, methyl, ethyl, isopropyl, isobutyl, isoamyl, chloromethyl, fluoromethyl, difluromethylmethoxymethyl, and n-butyl), an alkenyl group having a C number of 2 to 8 (preferably 2 to 4) (for example, vinyl, propenyl, and allyl), an alkynyl group having a C number of 2 to 8 (preferably 2 to 4) (for example, ethynyl and propargyl), a cycloalkyl group having a C number of 3 to 8 (preferably 3 to 5) (for example, cyclopropyl, 2-methylcyclopropyl, 1-methylcyclopropyl, 1-fluorocyclopropyl, and cyclobutyl), an aralkyl group having a C number of 7 to 12 (preferably 7 to 10) (for example, benzyl and phenethyl), an alkoxy group having a C number of 1 to 8 (preferably 1 to 4) (for example, methoxy and ethoxy), an amino group having a C number of 0 to 8 (preferably 0 to 4) (for example, amino, methylamino, ethylamino, dimethylamino, and pyrrolidyl), or an aryl group having a C number of 6 to 12 (preferably 6 to 10) (for example, phenyl, p-tolyl, p-methoxyphenyl, and o-tolyl). $R^1$ particularly preferably represents an alkyl group or a cycloalkyl group.

In Formulas (3-1a), (3-2a), (3-1b), (3-2b), (3-1c), and (3-2c), $R^3$ and $R^4$ each independently represents a hydrogen atom, an alkyl group, an aryl group, a halogen atom, an alkoxy group, or an aryloxy group, and each is preferably a hydrogen atom, an alkyl group having a C number of 1 to 24 (preferably 1 to 16) (for example, methyl, ethyl, isopropyl, n-butyl, and n-hexadecyl), an aryl group having a C number of 6 to 24 (preferably 6 to 12) (for example, phenyl), a halogen atom (F, Cl, Br and I), an alkoxy group having a C number of 1 to 24 (preferably 1 to 12) (for example, methoxy), or an aryloxy group having a C number of 6 to 24 (preferably 6 to 12) (for example, phenoxy). They are each particularly preferably a hydrogen atom or an alkyl group. When t is greater than one, the —$CR^3R^4$— groups may be the same or different.

In Formulas (3-1a), (3-2a), (3-1b), (3-2b), (3-1c), and (3-2c), $R^2$ and $R^7$ each independently represents a halogen atom (F, Cl, Br and I), an alkyl group having a C number of 1 to 12 (preferably 1 to 6) (for example, methyl, isopropyl, and t-butyl), a cycloalkyl group having a C number of 3 to 12 (preferably 3 to 6) (for example, cyclopropyl and cyclohexyl), an alkoxy group having a C number of 1 to 12 (preferably 1 to 6) (for example, methoxy and n-butoxy), an alkylthio group having a C number of 1 to 12 (preferably 1 to 6) (for example, methylthio and n-dodecylthio), an aryloxy group having a C number of 6 to 12 (preferably 1 to 10) (for example, phenoxy and p-t-butylphenoxy), an arylthio group having a C number of 6 to 12 (preferably 6 to 10) (for example, phenylthio), an alkylsulfonyl group having a C number of 1 to 12 (preferably 1 to 6) (for example, methylsulfonyl), an arylsulfonyl group having a C number of 6 to 12 (preferably 6 to 10) (for example, p-tolylsulfonyl), a carbonamido group having a C number of 1 to 12 (preferably 1 to 8) (for example, acetamido and benzamido), a sulfonamido group having a C number of 1 to 12 (preferably 1 to 8) (for example, methanesulfonamido and p-toluenesulfonamido), an acyl group having a C number of 1 to 12 (preferably 1 to 8) (for example, acetoxy and benzoyloxy), an acyloxy group having a C number of 1 to 12 (preferably 1 to 8) (for example, acetoxy), an alkoxycarbonyl group having a C number of 2 to 12 (preferably 2 to 10) (for example, ethoxycarbonyl), a carbamoyl group having a C number of 1 to 12 (preferably 1 to 7) (for example, N-methylcarbamoyl), a sulfamoyl group having a C number of 0 to 12 (preferably 0 to 8) (for example, N-ethylsulfamoyl), a ureido group having a C-number of 1 to 12 (preferably 1 to 8) (for example, 3-methylureido and 3-phenylureido), an alkoxycarbonylamino group having a C number of 2 to 12 (preferably 2 to 10) (for example, ethoxycarbonyl), a cyano group, or a nitro group. $R^2$ and $R^7$ particularly preferably represent a halogen atom, an alkyl group, an alkoxy group, an acyl group, a carbonamido group, a sulfonamido group, a carbamoyl group, a sulfamoyl group, or a cyano group, wherein when m or q is greater than one, the $R^2$ groups may be the same or different and when n or p is greater than one, the $R^7$ groups may be the same or different. In Formulas (3-1a), (3-1b) and (3-1c), $R^2$ may be substituted at any of the 2', 3', 4' and 5' positions, preferably at the 3', 4' or 5' position. In Formulas (3-2a), (3-2b) and (3-2c), $R^2$ may be substituted at any of the 2', 3', 5' and 6' positions, preferably at the 2' or 6' position. In Formulas (3-1a), (3-2a), (3-1b), (3-2b), (3-1c) and (3-2c), $R^7$ may be substituted at any of the 3, 5, 6, 7 and 8 positions, preferably at the 5, 6 or 7 position.

In Formulas (3-2a), (3-2b) and (3-2c), $R^5$ and $R^6$ each independently represents a hydrogen atom, an alkyl group or an aryl group, and each is preferably a hydrogen atom, an alkyl group having a C number of 1 to 24 (preferably 1 to 16) (for example, methyl, ethyl, isopropyl, n-butyl, and n-hexadecyl), or an aryl group having a C number of 6 to 24 (preferably 6 to 12) (for example, phenyl, tolyl and naphthyl). Particularly preferred groups are a hydrogen atom and an alkyl group. The case in which at least one of $R^5$ and $R^6$ is a hydrogen atom is most preferred.

In Formulas (3-1a), (3-2a), (3-1b), and (3-2b), Ball represents a group having a size and form sufficient to provide the couplers represented by these formulas with an anti-dispersing property, and is preferably an alkyl group, an aryl group, an alkoxy group, an aryloxy group, an alkylthio group, an arylthio group, an alkylsulfonyl group, an arylsulfonyl group, a carbonamido group, a sulfonamido group, a carbamoyl group, a sulfamoyl group, a ureido group, an alkoxycarbonylamino group, an acyl group, an acyloxy group, an alkylsulfonyloxy group, or an alkoxycarbonyl group, each having a C number of 6 to 36 (preferably 8 to 24). Particularly preferred groups include an alkyl group, an alkoxy group, an aryloxy group, an alkylthio group, a carbonamido group, a sulfonamido group, a carbamoyl group, a sulfamoyl group, a ureido group, and an alkoxycarbonyl group. Ball may be substituted at any of the 3, 5, 6, 7 and 8 positions in Formulas (3-1a) and (3-2a) and 2', 3', 4' and 5' positions in Formulas (3-1b) and (3-2b), preferably at the 5, 6 or 7 position in Formulas (3-1a) and (3-2a) and the 3', 4' or 5' position in Formulas (3-1b) and (3-2b).

In Formulas (3-1a), (3-2a), (3-1b) and (3-2b), $X_2$ represents a hydrogen atom or a coupling splitting-off group capable of splitting off upon a coupling reaction with an oxidation product of an aromatic primary amine developing agent, and $X_2$ is preferably a hydrogen atom, a halogen atom (F, Cl, Br and I), a sulfo group, a thiocyanate group, an alkoxy group having a C number of 1 to 16 (preferably 1 to 8), an aryloxy group having a C number of 6 to 16 (preferably 6 to 10), an alkylthio group having a C number of 1 to 16 (preferably 1 to 8), an arylthio group having a C number of 6 to 36 (preferably 6 to 24), a heterocyclic oxy group having a C number of 2 to 16 (preferably 2 to 12), a heterocyclic thio group having a C number of 2 to 36 (preferably 2 to 24), an acyloxy group having a C number of 1 to 24 (preferably 1 to 12), a sulfonyloxy group having a C number of 1 to 24 (preferably 1 to 12), a carbamoyloxy group having a C number of 2 to 24 (preferably 2 to 12), an azolyl group having a C number of 1 to 36 (preferably 1 to 24), an imido group having a C number of 4 to 36 (preferably 4 to 24), or a hydantoinyl group having a C number of 3 to 36 (preferably 3 to 16).

Preferably, $X_2$ is a relatively electron-attractive group such as a halogen atom, a sulfo group, a thiocyanate group, a heterocyclic thio group, an azolyl group, or an imido group. The use of such groups tends to result in less generation of stain (background stain) attributable to light and heat.

In Formulas (3-1a), (3-1b) and (3-1c), t is preferably 1 or 2, and m, n, p and q each are preferably 0 or 1. Particularly preferably, t is 1, and m, n, p and q are 0.

In Formulas (3-1c) and (3-2c), Ball* represents a group having a size and form sufficient to provide a coupler with an anti-dispersing property and is a coupling splitting-off group capable of splitting off upon a coupling reaction with an oxidation product of an aromatic primary amine developing agent. Ball* is preferably an alkoxy group having a C number of 6 to 36 (preferably 8 to 24), an aryloxy group, an alkylthio group, an arylthio group, a heterocyclic oxy group, a heterocyclic thio group, an acyloxy group, a sulfonyloxy group, a carbamoyloxy group, an azolyl group, or an imide group. Ball* is particularly preferably an alkoxy group, an aryloxy group, an acyloxy group, a sulfonyloxy group, or an imide group.

The cyan couplers represented by Formulas (3-1c) and (3-2c) may be in the form of a dimer or a polymer which is formed by combining with each other via Ball* or they may be in the form of a polymer type coupler in which they are bonded to polymer chains (for example, a polyethylene type polymer chain and a polyester condensed polymer chain). In this case, the above stated range of limitation on the carbon atom number in Ball* can be exceeded. The Ball* groups described in, for example, U.S. Pat. No. 4,690,889, columns 5 to 6, JP-A-62-276548, pp. 3 to 17, JP-A-1-224756, pp. 15 to 42, and European Patent (EP) 357069A, pp. 3 to 10 can be applied in cases in which a naphthol type coupler is bonded to a polymer chain. These references are also relevant for their disclosures of suitable copolymerizable monomers and polymerization methods.

Of the cyan couplers represented by Formulas (3-1a), (3-2a), (3-1b), (3-2b), (3-1c) and (3-2c), the couplers represented by Formulas (3-1a), (3-1b), (3-2b) and (3-2c) are particularly preferred from the standpoint of providing less aging change of the hue of the cyan color image.

Specific examples of the groups in Formulas (3-1a), (3-2a), (3-1b), (3-2b), (3-1c) and (3-2c) are shown below but the cyan couplers are not limited thereto.

Examples of $-NHCOR^1$:

$-NHCO$, $-NHCOCH_3$, $-NHCOC_2H_5$, $-NHCOC_3H_7i$ $-NHCOCH_2Cl$, $-NHCOCH_2F$,

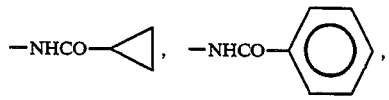

$-NHCOOCH_3$, $-NHCONHCH_3$

Examples of

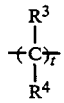

(t is 1 or more):

$-CH_2-$, $-(CH_2)_2-$, $-(CH_2)_3-$, $-(CH_2)_4-$,

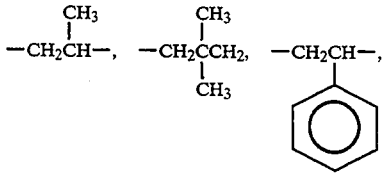

Examples of $-R^2$ and $-R^7$:

F, Cl, Br, I, $CH_3$, $-OCH_3$, $-NHCOCH_3$, $-NHSO_2H_3$, $-SCH_3$, $-SO_2CH_3$,

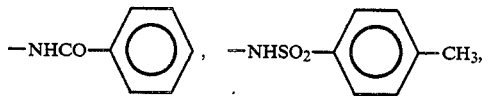

$-CONH_2$, $-SO_2NHC_2H_5$, $-NHCONHCH_3$, $-CF_3$, $-CN$, $-COCH_3$

Examples of

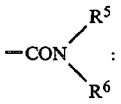

$-CONH_2$, $-CONHCH_3$, $-CONHC_2H_5$, $-CONHC_6H_{13}(n)$, $-CONHC_{12}H_{25}(n)$, $-CON(CH_3)_2$, $-CON(C_2H_5)_2$, $-CON(C_4H_9-n)_2$, $-CON(C_8H_{17}-n)_2$,

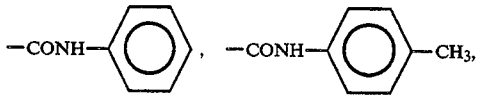

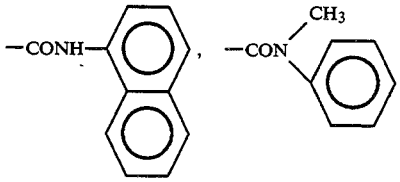

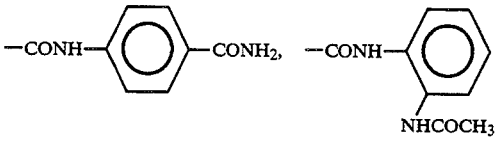

Examples of Ball:

$-OC_{12}H_{25}$,

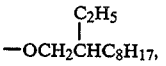

$-OCH_2CH_2OC_{12}H_{25}$, $-OCH_2COOC_{12}H_{25}$,

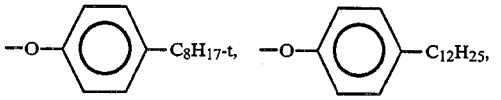

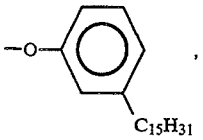

$-SC_{12}H_{25}$, $-SO_2C_{16}H_{33}$, $-COOC_{12}H_{25}$, $-SCH_2CH_2COOC_{12}H_{25}$, $-C_{12}H_{25}$, $-C_{15}H_{31}-t$, $-NHCOC_{15}H_{31}$, $-NHSO_2C_{12}H_{25}$, $-CONHC_{12}H_{25}$, $-SO_2NHC_{16}H_{33}$, $-NHCONHC_{12}H_{25}$,

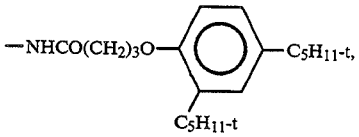

$-OCOC_{15}H_{31}$, $-OSO_2C_{12}H_{25}$,

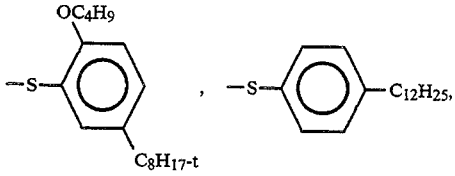

$-OCC_{16}H_{33}$

Examples of $X_2$:

H, F, Cl, Br, I, $-SO_3H$, $-SCN$, $-OCH_2COOH$, $-OCH_2COOCH_3$,

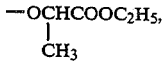

$-OCH_2CH_2Cl$, $-OCH_2CH_2SCH_2COOH$,

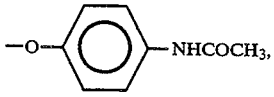

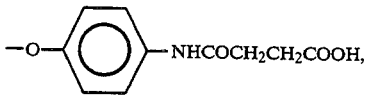

$-SCH_2COOH$, $-SCH_2CH_2COOH$, $-SCH_2CH_2OH$,

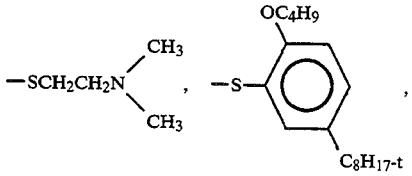

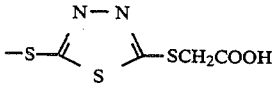

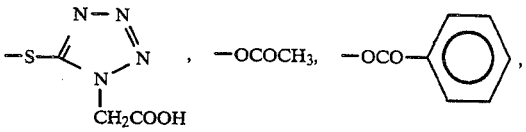

$-OSO_2CH_3$, $-OCOO_2H_5$, $-OCONHC_2H_5$, $-SO_2CH_3$,

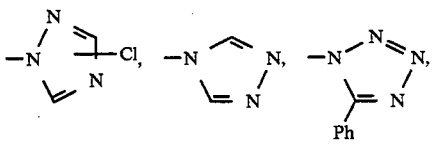
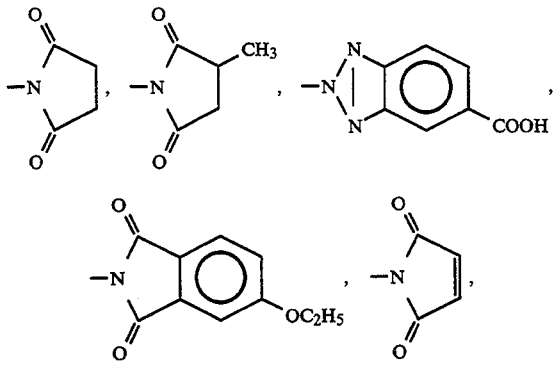
Examples of Ball*:
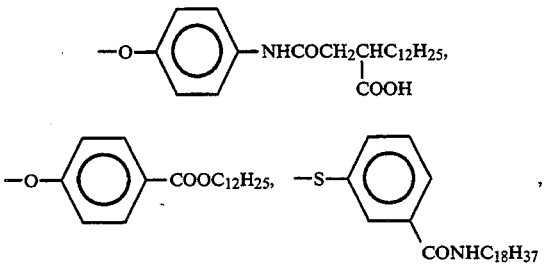
-continued
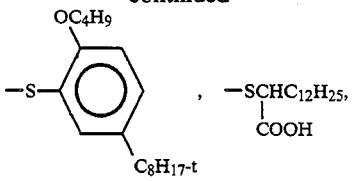
$-SCH_2COOC_{12}H_{25}$, $-OCOC_{15}H_{31}$, $-OSO_{216}H_{33}$, $-OCONHC_{12}H_{25}$,
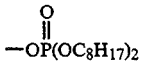
$-OCOOC_{12}H_{25}$,
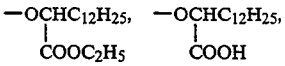
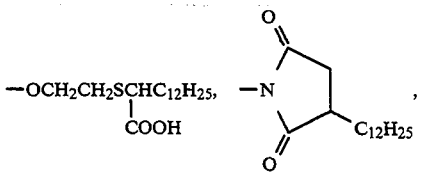
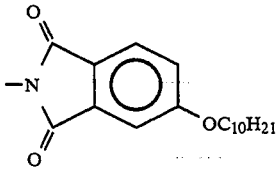
Specific examples of 1-naphthol type cyan couplers represented by Formulas (3-1) and (3-2) are shown below but the cyan couplers of these Formulas are not limited thereto.
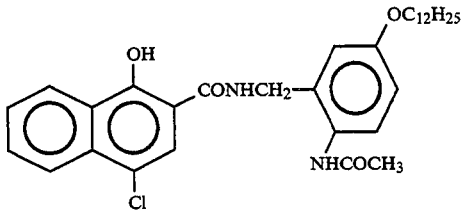
3-(1)
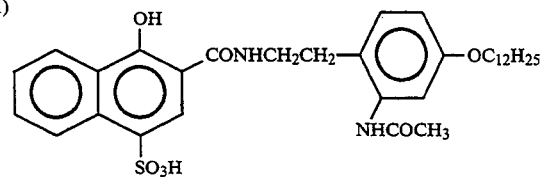
3-(2)
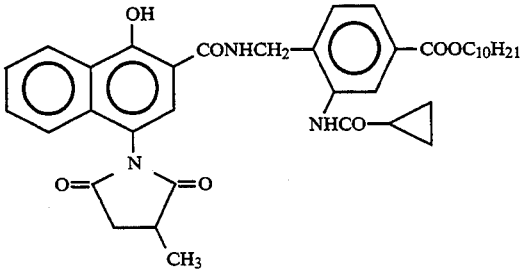
3-(3)
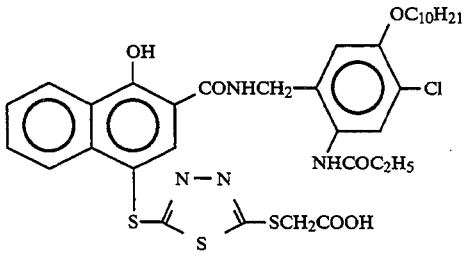
3-(4)

-continued
3-(5)
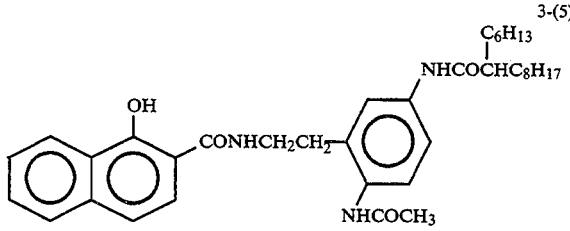
3-(6)
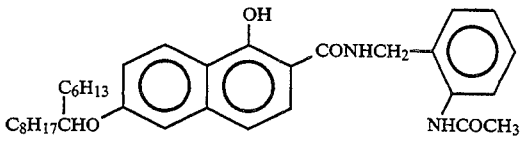
3-(7)
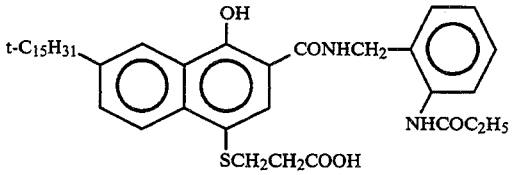
3-(8)
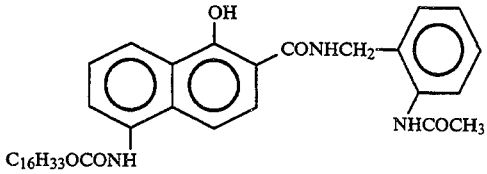
3-(9)
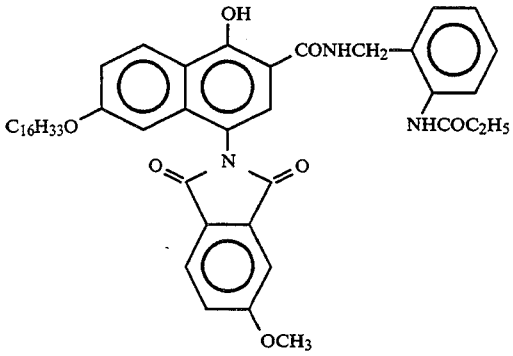
3-(10)
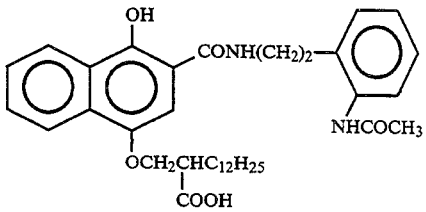
3-(11)
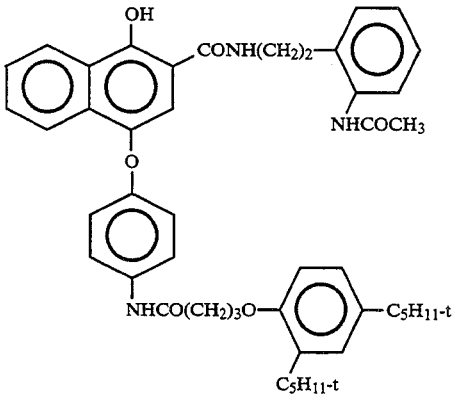
3-(12)
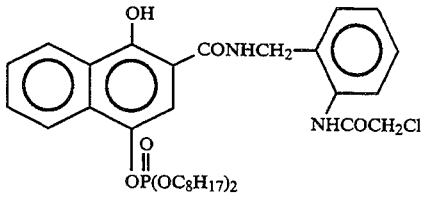
3-(13)
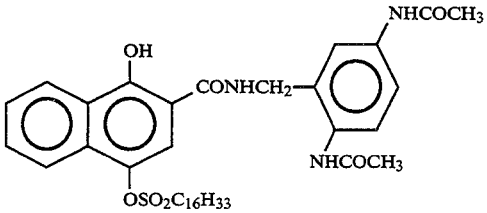
3-(14)
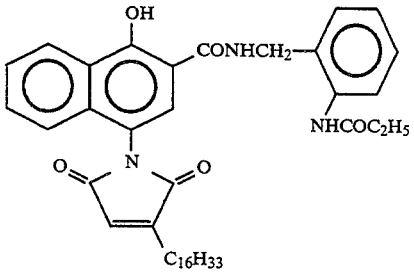

-continued
3-(15)
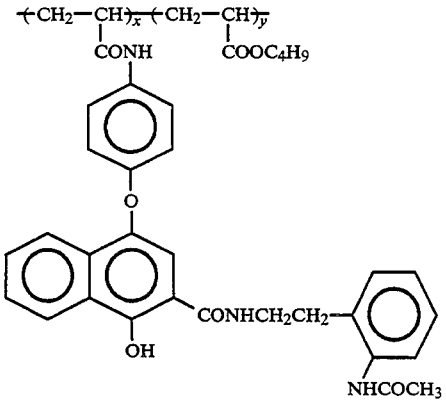
x:y = 50:50 (by weight)
3-(16)
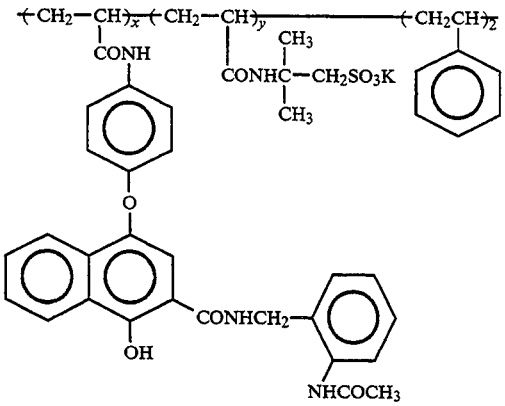
x:y:z = 55:45:10 (by weight)
3-(17)
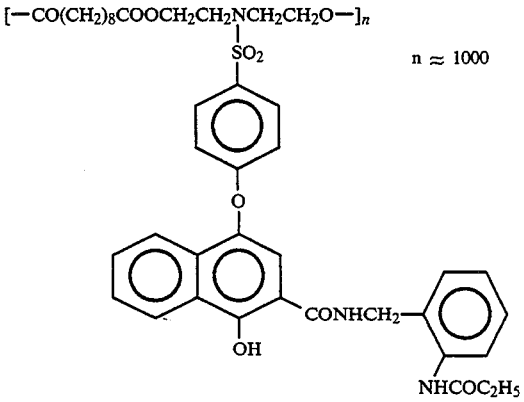
n ≈ 1000
3-(18)
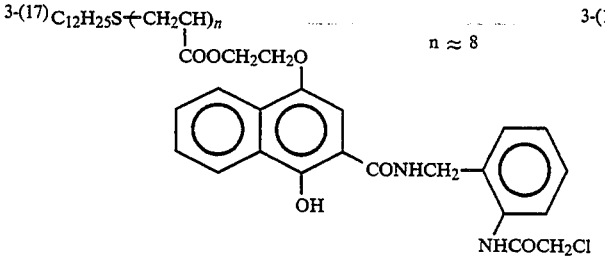
n ≈ 8
3-(19)
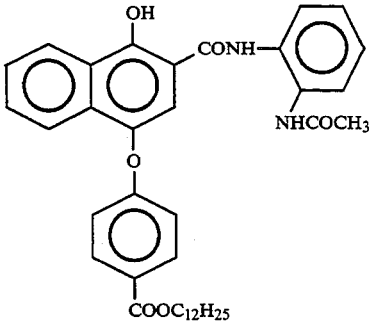
3-(20)
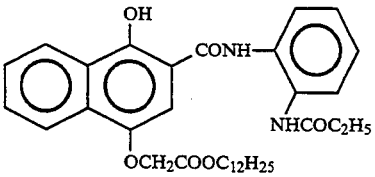
3-(21)
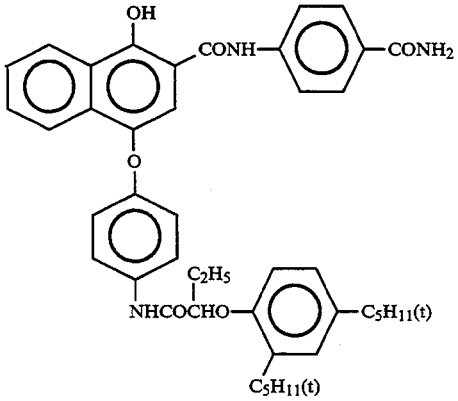
3-(22)
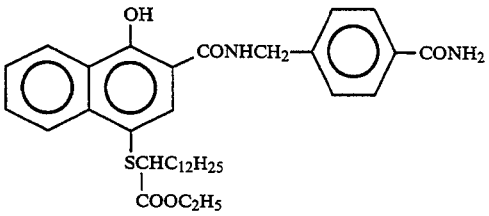

-continued 3-(23)

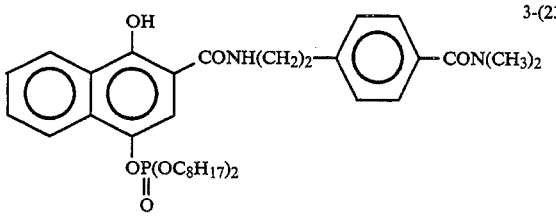

3-(24)

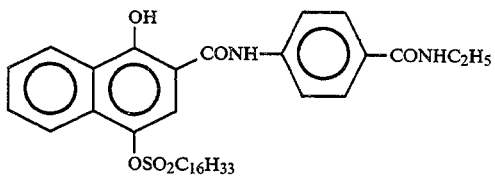

3-(25)

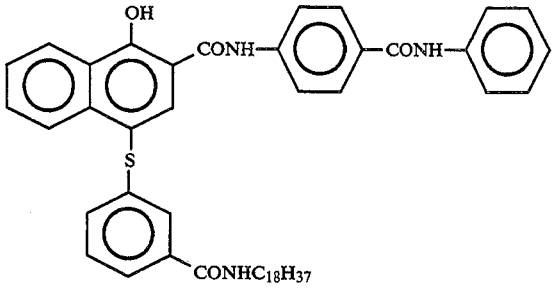

3-(26)

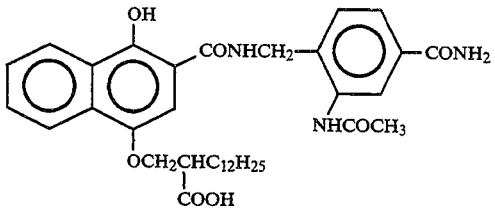

3-(27)

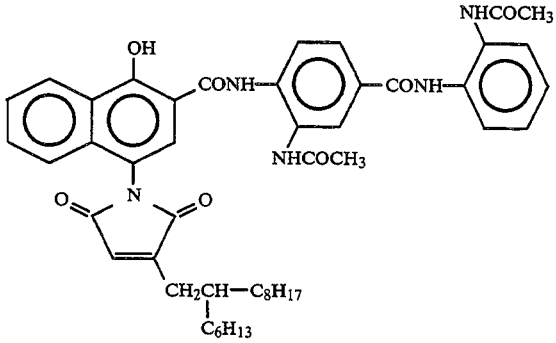

3-(28)

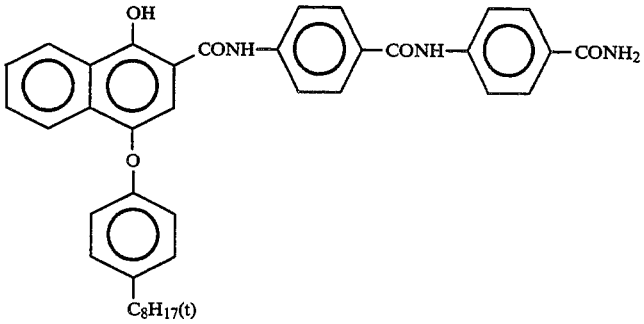

3-(29)

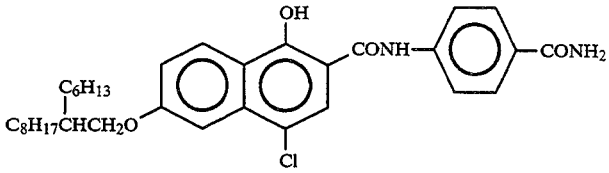

The cyan couplers of Formulas (V) and (VI) can be synthesized by conventional synthesis methods including the synthesis method described in JP-A-55-108662.

The mixing ratio of at least one of the pyrrolotriazole type cyan couplers (referred to as A) of the present invention represented by the above Formulas (I) and (II) and at least one of the cyan couplers (referred to as B) of the present invention represented by the above Formulas (III), (IV), (V) and (VI) can have an arbitrary range according to the performances provided to the photographic materials. A is preferably 30 mol % or more and 99 mol % or less, more preferably 50 mol % or more and 90 mol % or less.

The mixture consisting of the couplers A and B of the present invention is incorporated at least into a silver halide emulsion layer of the photographic material. It also is possible to add it to a non-light-sensitive layer adjacent thereto. In the present invention, the mixture is preferably incorporated into a light-sensitive silver halide emulsion layer, more preferably a silver halide emulsion layer which is red-sensitive or which has a sensitivity in the near infrared region.

The amount of the mixture consisting of the couplers A and B of the present invention to be added to the photographic material is generally $1\times10^{-3}$ to 2 mole, preferably $1\times10^{-2}$ to 1 mole and more preferably $5\times10^{-2}$ to 1 mole per mole of silver contained in the silver halide emulsion layer or per mole of silver contained in the silver halide emulsion layer adjacent thereto in case that the mixture is added to a non-light-sensitive layer.

Where the layer which is red-sensitive or which has a sensitivity in the near infrared region consists of plural layers, or the cyan couplers of the present invention are used in the other light-sensitive layers and non-light-sensitive layers in addition to these layers, the mixture consisting of the couplers A and B of the present invention can be used in any of these layers. In any given layer, either the mixture may have a different mixing ratio of A:B or the selected couplers A and B may be different.

Further, in case of plural layers, conventional couplers different from the above couplers of the present invention can also be used.

In order to incorporate the coupler mixture consisting of at least one of the pyrrolotriazole type cyan couplers of the present invention represented by the above Formulas (I) and (II) and at least one of the cyan couplers of the present invention represented by the above Formulas (III), (IV), (V) and (VI) into the photographic material, known dispersion methods can be used, such as the oil-in-water dispersion method in which a high boiling solvent is used, and the latex dispersion method, which will be explained later.

In the oil-in-water dispersion method in which a high boiling solvent is used, the weight ratio of the high boiling solvent to the total amount by weight of the couplers used can be arbitrarily selected. It is preferably 3.0 or less, more preferably 2.0 or less. A dispersion in which no high boiling solvent is used may also be applied.

With respect to the kind of the high boiling solvent, compounds having a boiling point of 175° C. or higher at a normal pressure can be used, which will be described later.

The use of the coupler mixture consisting of at least one of the pyrrolotriazole type cyan couplers of the present invention represented by the above Formulas (I) and (II) and at least one of the cyan couplers of the present invention represented by the above Formula (III), (IV), (V) and (VI) shows unexpected improved effects in that the defects of the respective couplers are compensated for and better performances are demonstrated while the excellent performances held by the respective couplers are maintained. In particular, excellent results of the cyan image are provided in terms of higher storage stability and color fastness due to higher color developability of the coupler such as higher coupling activity and higher color density and higher color reproducibility.

As the silver halide for use in the present invention, silver chloride, silver bromide, silver bromochloroiodide, and silver bromoiodide can be employed. Particularly for the purpose of rapid processing, it is preferable to use a silver bromochloride or silver chloride emulsion containing substantially no silver iodide and having a silver chloride content of 90 mol % or more, preferably 95 mol % or more and particularly preferably 98 mol % or more.

A substantial quantity of calcium ions are usually contained in gelatin, in many cases, 5000 ppm or more. Accordingly, in the present invention, deionized gelatin is preferably used. It is preferable to employ as the deionized gelatin used in the present invention, a gelatin containing 500 ppm or less of calcium ions. The deionized gelatin is used in the ratio of 10% by weight or more, more preferably 20% by weight or more based on the total amount by weight of the gelatins added.

For the purpose of improving the sharpness of the image, it is preferable to incorporate into a hydrophilic colloid layer of the photographic material according to the present invention, at least one dye (among them, an oxonol type dye) capable of being decolored by processing so that the optical reflection density of the photographic material at 680 nm becomes 0.70 or more, as described at pages 27 to 76 of European Patent EP 0 337 490A2, and into a hydrophobic resin layer of the support, titanium oxide which is subjected to a surface treatment with di- to tetrahydric alcohols (for example, trimethylolethane) in a proportion of 12% by weight or more (more preferably 14% by weight or more) based on the amount of hydrophobic resin on the support.

The photographic additives which can be used in the present invention, such as cyan, magenta and yellow couplers, are preferably used by dissolving them in a high boiling organic solvent. Any suitable high boiling organic solvent can be used so long as it is a compound which has a melting point of 100° C. or lower and a boiling point of 140° C. or higher and is immiscible with water, and is a good solvent for a coupler. The melting point of the high boiling organic solvent is preferably 80° C. or lower. The boiling point of the high boiling organic solvent is preferably 160° C. or higher, more preferably 170° C.

The details of these high boiling organic solvents are described in the right lower column at page 137 to the right upper column at page 144 of JP-A-62-215272.

A cyan, magenta or yellow coupler can be impregnated in a loadable latex polymer (see for example, U.S. Pat. No. 4,203,716) in the presence or absence of the above high boiling organic solvent, or the coupler can be dissolved together with a water-insoluble and organic solvent-soluble polymer to emulsify and disperse the coupler in a hydrophilic colloid aqueous solution.

It is preferable to use as the water-insoluble and organic solvent-soluble polymers the homopolymers or copolymers described in the seventh column to fifteenth column of U.S. Pat. No. 4,857,449 and at pages 12 to 30 of International Patent Publication W088/00723. It is more preferable to use the methacrylate type or acrylamide type polymers, and it is particularly preferable to use the acrylamide type polymers from the viewpoint of stabilizing the dye image.

Also, in the photographic material according to the present invention, the color image preservability-improving compounds described in European Patent 0,277,589A2 are preferably used together with couplers. In particular, they are preferably used in combination with a pyrazoloazole coupler.

To eliminate side effects, such as, for example, the generation of stain due to the reaction of a color developing agent or an oxidation product thereof remaining in a layer during storage after processing, it is preferable to use compounds (A) of EP 0,277,589A2 which chemically combine with an aromatic amine type developing agent remaining after a color development processing to form a chemically inactive and substantially colorless compound, and/or compounds (B) of EP 0,277,589A2 which chemically combine with the oxidation product of an aromatic amine type developing agent remaining after a color development processing to form a chemically inactive and substantially colorless compound.

Further, the anti-mold agents described in JP-A-63-271247 are preferably added to the photographic material according to the present invention for the purpose of preventing various molds and bacteria which grow in a hydrophilic colloid layer and deteriorate the image.

There may be used as a support for the photographic material according to the present invention for display, a white color polyester type support or a support in which a layer containing a white pigment is provided on a support side having a silver halide emulsion layer. An anti-halation layer is preferably provided on the support side on which a silver halide emulsion layer is coated or the backside thereof in order to further improve the sharpness. In particular, the transmission density of the support is preferably controlled to be 0.35 to 0.8 so that a display can be viewed with either reflected light or transmitted light.

The photographic material according to the present invention may be exposed with either visible light or infrared radiation. The exposing manner may be either a low illuminance exposure or a high illuminance exposure for a short time. Particularly in the latter case, a laser scanning exposing method in which the exposing time per picture element is shorter than $10^{-4}$ second is preferred.

In exposure, a band stop filter described in U.S. Pat. No. 4,880,726 is preferably used, whereby a light mixture is removed to notably improve color reproduction.

The exposed photographic material can be subjected to conventional development processing. In the case of a color photographic material, the material is preferably subjected to a bleach-fixing treatment after color development for the purpose of rapid processing. In particular, where the above high silver chloride emulsion is used, the pH of the bleach-fixing solution is preferably about 6.5 or less, more preferably 6 or less, for the purpose of accelerating desilvering.

Preferred silver halide emulsions, additives, layer arrangements, processing methods, and additives for processing for use with the photographic material of the present invention include those described in the following patent publications, particularly European Patent Publication EP 0,355,660A2 (JP-A-2-39544):

TABLE 1-5

| Photographic element | JP-A-62-215272 | JP-A-2-33144 | EP 0355660A2 |
|---|---|---|---|
| Silver halide emulsion | p. 10, right upper column, line 6 to p. 12, left lower column, line 5, and p. 12, right lower column, line 4 from bottom to p. 13, left upper column, line 17. | p. 28, right upper column, line 16 to p. 29, right lower column, line 11, and p. 30, line 2 to 5. | p. 45, line 53 to p. 47, line 3, and p. 47, line 20 to 22. |
| Silver halide solvent | p. 12, left lower column, line 6 to 14, and p. 13, left upper column, line 3 from bottom to p. 18, left lower column, last line. | — | — |
| Chemical sensitizer | p. 12, left lower column, line 3 from bottom to right lower column, line 5 from bottom, and p. 18, right lower column, line 1 to p. 22, right upper column, line 9 from bottom. | p. 29, right lower column, line 12 to last line. | p. 47, line 4 to 9. |
| Spectral sensitizer (spectral sensitizing method) | p. 22, right upper column, line 8 from bottom to p. 38, last line. | p. 30, left upper column, line 1 to 13. | p. 47, line 10 to 15. |
| Emulsion stabilizer | p. 39, left upper column, line 1 to p. 72, right upper column, last line. | p. 30, left upper column, line 14 to right upper column, line 1. | p. 47, line 16 to 19. |
| Development accelerator | P. 72, left lower column, line 1 to p. 91, right upper column, line 3. | — | — |
| Color coupler (cyan, magenta and yellow couplers) | p. 91, right upper column, line 4 to p. 121, left upper column, line 6. | p. 3, right upper column, line 14 to p. 18, left upper column, last line, and p. 30, right upper column, line 6 to p. 35 right lower column, line 11. | p. 4, line 15 to 27, p. 5, line 30 to p. 28, last line, and p. 47, line 23 to p. 63, line 50. |
| Color forming accelerator | p. 121, left upper column, line 7 to P. 125, right upper column, line 1. | — | — |
| UV absorber | p. 125, right upper column, line 2 to p. 127, left lower column, last line. | p. 37, right lower column, line 14 to p. 38, left upper column, line 11. | p. 65, line 22 to 31. |
| Anti-fading agent (an image stabilizer) | p. 127, right lower column, line 1 to p. 137, left lower column, line 8. | p. 36, right upper column, line 12 to p. 37, left upper column, line 19. | p. 4, line 30 to p. 5, line 23, p. 29, line 1 to p. 45, line 25, p. 45, line 33 to 40, and |

TABLE 1–5-continued

| Photographic element | JP-A-62-215272 | JP-A-2-33144 | EP 0355660A2 |
|---|---|---|---|
| | | | p. 65, line 2 to 21. |
| High boiling and/or low boiling organic solvent | p. 137, left lower column, line 9 to p. 144, right upper column, last line. | p. 35, right lower column, line 14 to p. 36, left upper, line 4. | p. 64, line 1 to 51. |
| Method for dispersing photographic additives | p. 144, left lower column, line 1 to p. 146, right upper column, line 7. | p. 27, right lower column, line 10 to p. 28, left upper, last line, and p. 35, right lower column, line 12 to p. 36, right upper column, line 7. | p. 63, line 51 to p. 64, line 56. |
| Hardener | p. 146, right upper column, line 8 to p. 155, left lower column, line 4. | — | — |
| Precursor of a developing agent | p. 155, left lower column, line 5 to right lower column, line 2. | — | — |
| Development inhibitor-releasing compound | p. 155, right lower column, line 3 to 9. | — | — |
| Support | p. 155, right lower column, line 19 to p. 156, left upper column, line 14. | p. 38, right upper column, line 18 to p. 39, left upper column, line 3. | p. 66, line 29 to p. 67, line 13. |
| Light-sensitive layer structure | p. 156, left upper column, line 15 to right lower column, line 14. | p. 28, right upper column, line 1 to 15. | p. 45, line 41 to 52. |
| Dye | p. 156, right lower column, line 15 to p. 184, right lower column, last line. | p. 38, left upper column, line 12 to right upper column, line 7. | p. 66, line 18 to 22. |
| Anti-color mixing agent | p. 185, left upper column, line 1 to p. 188, right lower column, line 3. | p. 36, right upper column, line 8 to 11. | p. 64, line 57 to line 1. |
| Gradation controller | p. 188, right lower column, line 4 to 8. | — | |
| Anti-stain agent | p. 188, right lower column, line 9 to p. 193, right lower column, line 10. | p. 37, left upper column, last line to right lower column, line 13. | p. 65, line 32 to p. 66, line 17. |
| Surface active agent | p. 201, left lower column, line 1 to p. 210, right upper column, last line | p. 18, right upper column, line 1 to p. 24, right lower column, last line, and p. 27, left lower column, line 10 from bottom to right lower column, line 9. | — |
| Fluorinated compound (anti-electrification agent, coating aid, lubricant and anti-adhesion agent) | p. 210, left lower column, line 1 to p. 222, left lower column, line 5. | p. 25, left upper column, line 1 to p. 27, right lower column, line 9. | |
| Binder (hydrophilic colloid) | p. 222, left lower column, line 6 to p. 225, left upper column, last line | p. 38, right upper column, line 8 to 18. | p. 66, line 23 to 28. |
| Thickener | p. 225, right upper column, line 1 to p. 227, right upper column, line 2. | — | — |
| Anti-electrification agent | p. 227, right upper column, line 3 to p. 230, left upper column, line 1. | — | — |
| Polymer latex | p. 230, left upper column, line 2 to p. 239, last line | — | — |
| Matting agent | p. 240, left upper column, line 1 to right upper column, last line. | — | — |
| Photographic processing method (processing steps and additives) | p. 3, right upper column, line 7 to p. 10, right upper column, line 5. | p. 39, left upper column, line 4 to p. 42, left upper column, last line. | p. 67, line 14 to p. 69, line 28. |

Remarks:

1. There is included in the cited items of JP-A-62-215272, the subject matter amended according to the Amendment of March 16, 1987.

2. Of the above color couplers, also preferably used are the so-called short wave type yellow couplers described in JP-A-63-231451, JP-A-63-123047, JP-A-63-241547, JP-A-1-173499, JP-A-1-213648, and JP-A-1-250944, and also preferably used are the yellow couplers described in EP 447,969A, and EP 482,552A.

The method described in the left upper column at page 27 to the right upper column at page 34 of JP-A-2-207250 is preferably applied as the method for processing a photographic material comprising a high silver chloride emulsion having a silver chloride content of 90 mol % or higher.

The present invention will be explained in more detail below with reference to examples but is not limited thereto.

EXAMPLE 1

Tricresyl phosphate (20.4 g) as a high boiling solvent and ethyl acetate (20.4 ml) were added to Exemplified Compound (19) ($2.0\times10^{-2}$ mole) as the pyrrolotriazole cyan coupler of the present invention represented by the above Formula (III) to dissolve it, and the solution was added to a 10 wt % gelatin aqueous solution (200 g) containing sodium dodecylbenzenesulfonate (1.5 g) and emulsified with a homogenizer.

The whole amount of this emulsion was added to a high silver chloride emulsion 123 g(silver: 70.0 g/kg of the emulsion and a silver bromide content: 0.5 mol %), and the coating solution thus prepared was applied on a triacetate film base provided with a subbing layer so that the coated silver amount became 0.65 g/m$^2$.

A gelatin layer was provided as a protective layer on this coated layer so that the dry thickness became 1.0 $\mu$, whereby a sample was prepared. Sodium 1-oxy-3,5-dichloro-s-triazine was added as a gelatin hardener in an amount of 0.02 g per g of gelatin.

The sample thus prepared was designated Sample 101.

Next, Samples 102 to 124 were prepared in the same manner as Sample 101 except that the above Exemplified Compound (1) was replaced with equimolar amounts of the other couplers as shown in Tables 6 and 7, wherein the weight ratios of tricresyl phosphate and the high boiling solvent to the couplers were adjusted so that they became 1.0 similarly to that of Sample 101. The mixing ratio of each sample in which two couplers were mixed was 1/1 by mole.

These Samples 101 to 124 thus prepared were subjected to a gradation exposure with a white light (color temperature of light source: 3200° K.), wherein the exposure was adjusted so that it became 250 CMS at an exposing time of 0.1 second. The exposed samples were processed using the following steps:

| Processing step | Temperature | Time |
|---|---|---|
| Color developing | 35° C. | 45 seconds |
| Bleach/fixing | 35° C. | 45 seconds |
| Stabilizing (1) | 35° C. | 20 seconds |
| Stabilizing (2) | 35° C. | 20 seconds |
| Stabilizing (3) | 35° C. | 20 seconds |
| Stabilizing (4) | 35° C. | 20 seconds |
| Drying | 80° C. | 60 seconds |

Stabilizing was carried out using a 4 tank countercurrent system from (4) to (1).

The compositions of the respective processing solutions were as follows:

| | |
|---|---|
| Color developing solution | |
| Water | 800 ml |
| 1-Hydroxyethylidene-1,1-diphosphonic acid (60%) | 0.8 ml |
| Triethanolamine | 8.0 g |
| Sodium chloride | 1.4 g |
| Potassium bromide | 0.03 g |
| N,N-diethylhydroxylamine | 4.6 g |
| Potassium carbonate | 27 g |
| Sodium sulfite | 0.1 g |
| N-ethyl-N-(β-methanesulfonamidethyl)-3-methyl-4-aminoaniline 3/2 sulfate monohydrate | 4.5 g |
| Lithium sulfate (anhydrous) | 2.7 g |
| Fluorescent whitening agent (4,4'-diaminostilbene type) | 2.0 g |
| Water was added to make the total quantity | 1000 ml |
| pH (adjusted with potassium hydroxide) | 10.25 |
| Bleach/fixing solution | |
| Water | 400 ml |
| Ammonium thiosulfate (700 g/liter) | 100 ml |
| Sodium sulfite | 18 g |
| Iron (III) ammonium ethylenediaminetetracetate | 55 g |
| Disodium ethylenediaminetetracetate | 3 g |
| Glacial acetic acid | 9 g |
| Water was added to make the total quantity | 1000 ml |
| pH | 5.4 |
| Stabilizing solution | |
| Benzoisothiazoline | 0.02 g |
| Polyvinylpyrrolidone | 0.05 g |
| Water was added to make the total quantity | 1000 ml |
| pH | 7.0 |

The samples thus obtained after processing were subjected to density measurements of the cyan dye image to obtain the characteristic curves. The following characteristic values were obtained from these characteristic curves.

(1) Photographic characteristic:

The logarithm of the exposure which gave the minimum density (Dmin) +0.5 was obtained from the characteristic curve, and the differences in this value (ΔS) between the respective samples and Sample 101, which was used as the reference were calculated. A positive value of ΔS means a high sensitivity and a negative value means a low sensitivity.

The density values of the respective samples, which were given by the high exposure of log E=0.4 were obtained from the above characteristic curve, and the density ratios (D %) of the respective samples with respect to Sample 101, which was similarly used as the reference, were determined. A higher value shows that a higher dye density was obtained.

(2) Dye image fastness:

One set of the samples in which the processing and density measurements were finished was stored at the condition of 100° C. for 5 days, and the other set thereof was stored at the condition of 80° C. and 70% relative humidity (RH) for 7 days. Then, the respective samples were subjected once again to density measurements. The density of the portion giving a density of 1.5 before the exposure test was measured after the test and the respective density ratios ($D_1$% and $D_2$%) thereof to the density (1.5) before the test was determined to obtain a dye image residual rate. A larger value shows that the fastness of the dye image was higher.

(3) Color reproducibility:

The cyan dye images thus obtained after processing were measured to determine their red densities as well as their blue densities, and the blue densities corresponding to the exposures which gave a red density of 1.0 in these characteristic curves were determined. The differences (ΔD) thereof from the blue density of Sample 101 which was used as the reference were obtained. A larger positive value shows that the density in the blue light region was high and that an absorption which is not preferred in terms of color reproduction was present, while a larger negative value shows that the sample gave preferred results in terms of color reproduction.

These results thus obtained are summarized in Tables 6 and 7.

TABLE 6

| Sample No. | Coupler A | Coupler B | Photographic characteristic ΔS | Photographic characteristic D (%) | Dye image fastness 80° C., 70% | Dye image fastness 100° C. | Color reproducibility |
|---|---|---|---|---|---|---|---|
| 101 (comp.) | (19) | — | 0.00* | 100* | 91 | 94 | 0.00* |
| 102 (Comp.) | (17) | — | 0.00 | 99 | 90 | 94 | 0.00 |
| 103 (Comp.) | 1C-3 | — | −0.12 | 82 | 94 | 92 | +0.08 |
| 104 (Comp.) | 2C-15 | — | −0.15 | 75 | 99 | 99 | +0.07 |
| 105 (Comp.) | 3-(1) | — | −0.16 | 73 | 85 | 99 | +0.05 |
| 106 (Comp.) | 3-(21) | — | −0.18 | 68 | 84 | 99 | +0.04 |
| 107 (Comp.) | Comparative coupler (a) | — | −0.30 | 40 | 98 | 99 | 0.00 |
| 108 (Comp.) | Comparative coupler (b) | — | −0.33 | 38 | 94 | 97 | 0.00 |
| 109 (Comp.) | Comparative coupler (c) | — | −0.37 | 32 | 87 | 93 | +0.01 |
| 110 (Inv.) | (19) | 1C-3 | +0.02 | 98 | 96 | 96 | +0.02 |
| 111 (Inv.) | (19) | 2C-15 | −0.02 | 96 | 100 | 100 | +0.01 |
| 112 (Inv.) | (19) | 3-(1) | −0.02 | 95 | 93 | 100 | 0.00 |

*Standard

TABLE 7

| Sample No. | Coupler A | Coupler B | Photographic characteristic ΔS | Photographic characteristic D (%) | Dye image fastness 80° C., 70% | Dye image fastness 100° C. | Color reproducibility |
|---|---|---|---|---|---|---|---|
| 113 (Inv.) | (19) | 3-(21) | −0.03 | 93 | 93 | 100 | 0.00 |
| 114 (Comp.) | (19) | Comparative coupler (a) | −0.26 | 48 | 90 | 93 | 0.00 |
| 115 (Comp.) | (19) | Comparative coupler (b) | −0.29 | 46 | 88 | 92 | 0.00 |
| 116 (Comp.) | (19) | Comparative coupler (c) | −0.32 | 38 | 83 | 90 | 0.00 |
| 117 (Inv.) | (17) | 1C-3 | +0.02 | 98 | 96 | 96 | +0.02 |
| 118 (Inv.) | (17) | 2C-15 | −0.02 | 96 | 100 | 100 | +0.01 |
| 119 (Inv.) | (17) | 3-(1) | −0.02 | 95 | 92 | 100 | 0.00 |
| 120 (Inv.) | (17) | 3-(21) | −0.03 | 93 | 92 | 100 | 0.00 |
| 121 (Comp.) | (17) | Comparative coupler (a) | −0.27 | 68 | 89 | 93 | 0.00 |
| 122 (Comp.) | (17) | Comparative coupler (b) | −0.30 | 66 | 87 | 92 | 0.00 |
| 123 (Comp.) | (17) | Comparative coupler (c) | −0.33 | 62 | 82 | 90 | 0.00 |
| 124 (Comp.) | 1C-3 | Comparative coupler (a) | −0.25 | 63 | 90 | 90 | +0.04 |

Comparative Coupler (a) (Compound [III]-3-2 described in U.S. Patent 4,873,183)

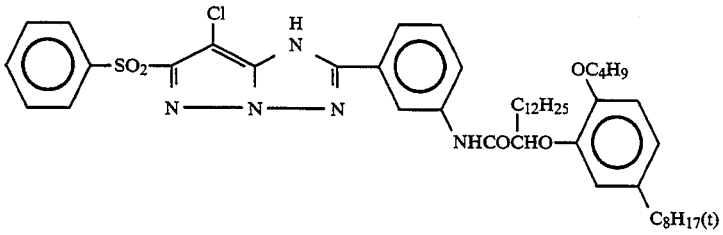

Comparative Coupler (b) (Compound [III]-3-21 described in U.S. Patent 4,873,183)

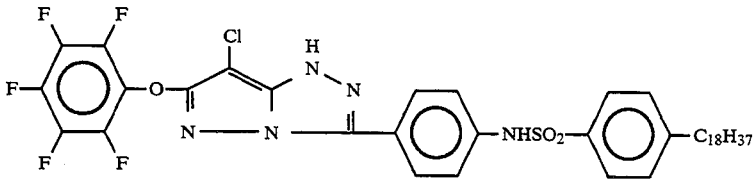

Comparative Coupler (c) (Compound (I) described in EP 342637A2)

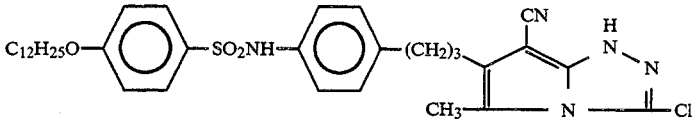

It is apparent from the results summarized in the above tables that in a comparison of Samples 110 to 113 and 117 to 120 (Invention Samples) with Samples 101 to 109, 114 to 116 and 121 to 124 (Comparisons), the combined use of a pyrrolotriazole type cyan coupler of the present invention represented by Formula (I) or (II) and a cyan coupler of the present invention represented by Formula (III), (IV), (V) or (VI) can give a high color developability (i.e., high sensitivity and color density) and provide excellent dye image fastness and color reproducibility.

In particular, it is an unexpected effect that the combined use of a pyrrolotriazole type cyan coupler of the present invention represented by Formula (I) or (II) and a cyan coupler of the present invention represented by Formula (III), (IV), (V) or (VI) can improve the color developability and dye image fastness more than the single uses thereof.

EXAMPLE 2

Samples 201 to 224 were prepared in the same manner as the respective samples in Example 1 except that the Couplers (19) and 1C-8 used in Example 1 were replaced with equimolar amounts of the couplers shown in Tables 8 and 9, wherein the amounts of tricresyl phosphate and the high boiling solvent with respect to the couplers were adjusted so that the weight ratios thereof became constant similarly to Example 1.

These samples thus prepared were subjected to exposure and processing and then to an evaluation of their performances in the same manner as Example 1, wherein Sample 101 prepared in Example 1 was used as the reference for evaluating the performances of the photographic characteristics and color reproducibility. The results are summarized in Tables 8 and 9.

TABLE 8

| Sample No. | Coupler A | Coupler B | Photographic characteristic ΔS | Photographic characteristic D (%) | Dye image fastness 80° C., 70% | Dye image fastness 100° C. | Color reproducibility |
|---|---|---|---|---|---|---|---|
| 201 (Inv.) | (4) | 1C-3 | +0.03 | 98 | 96 | 96 | +0.02 |
| 202 (Inv.) | (4) | 1C-3 | +0.02 | 98 | 97 | 97 | +0.02 |
| 203 (Inv.) | (52) | 1C-3 | +0.03 | 98 | 97 | 97 | +0.01 |
| 204 (Inv.) | (6) | 1C-3 | +0.02 | 98 | 97 | 97 | +0.02 |
| 205 (Inv.) | (55) | 1C-3 | +0.03 | 98 | 96 | 96 | +0.02 |
| 206 (Inv.) | (20) | 1C-3 | +0.02 | 97 | 96 | 96 | +0.02 |
| 207 (Inv.) | (36) | 1C-3 | +0.02 | 98 | 95 | 96 | +0.01 |
| 208 (Inv.) | (39) | 1C-3 | +0.02 | 98 | 95 | 96 | +0.01 |
| 209 (Inv.) | (40) | 1C-3 | +0.02 | 97 | 95 | 96 | +0.01 |
| 210 (Inv.) | (24) | 1C-3 | 0.00 | 96 | 94 | 95 | +0.03 |
| 211 (Inv.) | (28) | 1C-3 | 0.00 | 96 | 94 | 95 | +0.03 |
| 212 (Inv.) | (22) | 1C-3 | −0.01 | 95 | 94 | 94 | +0.03 |

TABLE 9

| Sample No. | Coupler A | Coupler B | Photographic characteristic ΔS | Photographic characteristic D (%) | Dye image fastness 80° C., 70% | Dye image fastness 100° C. | Color reproducibility |
|---|---|---|---|---|---|---|---|
| 213 (Inv.) | (47) | 1C-3 | −0.01 | 95 | 94 | 94 | +0.03 |
| 214 (Inv.) | (49) | 1C-3 | −0.02 | 94 | 93 | 93 | +0.03 |
| 215 (Inv.) | (1) | IC-1 | +0.02 | 98 | 97 | 98 | +0.02 |
| 216 (Inv.) | (1) | 2C-12 | −0.02 | 96 | 100 | 100 | +0.01 |
| 217 (Inv.) | (1) | 2C-17 | −0.02 | 96 | 100 | 100 | +0.01 |
| 218 (Inv.) | (1) | 2C-23 | 0.00 | 97 | 99 | 99 | +0.01 |
| 219 (Inv.) | (1) | 2C-26 | +0.05 | 108 | 100 | 100 | +0.02 |
| 220 (Inv.) | (1) | 3-(14) | −0.02 | 95 | 93 | 100 | 0.00 |
| 221 (Inv.) | (1) | 3-(26) | −0.03 | 94 | 93 | 100 | 0.00 |
| 222 (Inv.) | (39)/(51) (1/1 by mol) | 1C-5 | +0.04 | 100 | 97 | 97 | +0.01 |
| 223 (Inv.) | (39)/(51) (1/1 by mol) | 2C-19 | +0.01 | 96 | 98 | 99 | 0.00 |
| 224 (Inv.) | (39)/(51) (1/1 by mol) | 2C-28 | +0.04 | 107 | 100 | 100 | +0.02 |

It is apparent from the results summarized in Tables 8 and 9 that in comparing with the results in Example 1, the combinations of the cyan couplers according to the constitution of the present invention gave almost the same results as those obtained with the corresponding combinations in Example 1.

To be more specific, it is apparent from the comparisons of Samples 201 to 206 and 210 to 212, and 207 to 209 and 213 to 214 that, of the pyrrolotriazole type couplers represented by Formulas (I) and (II), the couplers represented by Formula (I) are more excellent in terms of their photographic characteristics, dye image fastness and color reproducibility.

EXAMPLE 3

A paper support laminated on both sides thereof with polyethylene, which was subjected to a corona discharge treatment, was provided with a gelatin subbing layer containing sodium dodecylbenzenesulfonate, and further was coated with various photographic constitutional layers, whereby a multilayered color photographic paper (Sample 301) having the following layer constitution was prepared. The coating solutions were prepared in the following manner.

Preparation of the first layer coating solution

A yellow coupler (ExY) (153.0 g), a dye image stabilizer (Cpd-1) (15.0 g), a dye image stabilizer (Cpd-2) (7.5 g), and a dye image stabilizer (Cpd-3) (16.0 g) were dissolved in a solvent (Solv-1) (25 g), a solvent (Solv-2) (25 g) and ethyl acetate (180 ml), and this solution was dispersed in a 10% aqueous gelatin solution (1000 g) containing 60 ml of a 10% sodium dodecylbenzenesulfonate aqueous solution and citric acid (10 g), to thereby prepare an emulsified dispersion A.

Meanwhile, there was prepared a silver bromochloride emulsion A (cubic, a 3:7 mixture by Ag mole ratio of a large size emulsion A with an average grain size of 0.88 μm and a small size emulsion A with an average grain size of 0.70 μm, wherein the variation coefficients in the grain size distributions were 0.08 and 0.10, respectively, and both size emulsions contained grains in which AgBr 0.3 mol % was located on a part of the surface thereof). The variation coefficients is obtained by dividing a standard deviation of particle size by average particle size. Provided that a diameter and number of each particles are $r_i$ and $n_i$, respectively, the average may be defined by the following equation.

$$\bar{r} = \frac{\Sigma n_i \times r_i}{\Sigma n_i}$$

Accordingly, the standard deviation (S) may be defined as follows:

$$S = \sqrt{\frac{\Sigma(\bar{r} - r_i)^2 \times n_i}{\Sigma n_i}}$$

The diameter of each particles used herein is a corresponding diameter of the projected area obtained by the well known method with an electron microscope, as disclosed in "The Theory of the Photographic Process" 3rd. ed., pages 36 to 43, published by Macmillan, 1966. Added to this emulsion were the following blue-sensitive sensitizing dyes A and B each in the amount of $2.0\times10^{-4}$ mole per mole of silver to the large size emulsion A and each in the amount of $2.5\times10^{-4}$ mole per mole of silver to the small size emulsion A. Further, this emulsion was subjected to a chemical ripening after adding a sulfur sensitizer and a gold sensitizer. The foregoing emulsified dispersion A and this red-sensitive silver bromochloride emulsion A were mixed and dissolved, whereby the first layer coating solution was prepared so that it was of the following composition.

Preparation of the fifth layer coating solution

Ethyl acetate (60.0 ml) was added to a cyan coupler (ExC) (33.0 g), a UV absorber (UV-2) (18.0 g), a dye image stabilizer (Cpd-1) (30.0 g), a dye image stabilizer (Cpd-9) (15.0 g), a dye image stabilizer (Cpd-10) (15.0 g), a dye image stabilizer (Cpd-11) (1.0 g), a dye image stabilizer (Cpd-8) (1.0 g), a dye image stabilizer (Cpd-6) (1.0 g), a solvent (Solv-6) (35.0 g), and a solvent (Solv-1) (2.0 g) to dissolve them. This solution was added to a 20% aqueous gelatin solution (500 ml) containing sodium dodecylbenzenesulfonate (8 g), and then was dispersed with a supersonic homogenizer to thereby prepare an emulsified dispersion C.

Meanwhile, there was prepared a silver bromochloride emulsion C (cubic, a 1:4 mixture by Ag mole ratio of a large size emulsion C with an average grain size of 0.50 μm and a small size emulsion C with an average grain size of 0.41 μm, wherein the variation coefficients of the grain size distributions were 0.09 and 0.11, respectively, and both size emulsions contained grains in which AgBr 0.8 mol % was located on a part of the surface thereof). Added to this emulsion C was the following red-sensitive sensitizing dye E in the amount of $0.9\times10^{-4}$ mole per mole of silver to the large size emulsion C and in the amount of $1.1\times10^{-4}$ mole per mole of silver to the small size emulsion C. Further, the following compound F was added in an amount of $2.6\times10^{-3}$ mole per mole of silver halide. Also, this emulsion C was subjected to a chemical ripening after adding a sulfur sensitizer and a gold sensitizer. The foregoing emulsified dispersion C and this red-sensitive silver bromochloride emulsion C were mixed and dissolved, whereby the fifth layer coating solution was prepared so that it was of the following composition.

The coating solutions for the 2nd layer to 4th layer, the 6th layer and the 7th layer were prepared in a manner similar to the method used to prepare 1st layer coating solution. Sodium 1-oxy-3,5-dichloro-s-triazine was used as the hardener for the respective layers.

Further, Cpd-14 and Cpd-15 were added to the respective layers so that the entire amounts thereof became 25.0 mg/m$^2$ and 50.0 mg/m$^2$, respectively.

The following spectral sensitizing dyes were used for the silver bromochloride emulsions contained in the respective light-sensitive emulsion layers.

Blue-sensitive emulsion layer

Sensitizing dye A

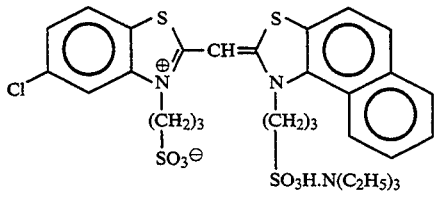

and

Sensitizing dye B

-continued

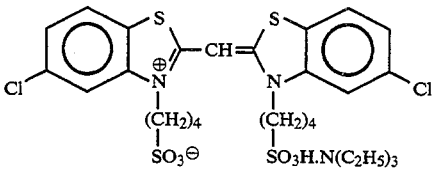

Green-sensitive emulsion layer
Sensitizing dye C

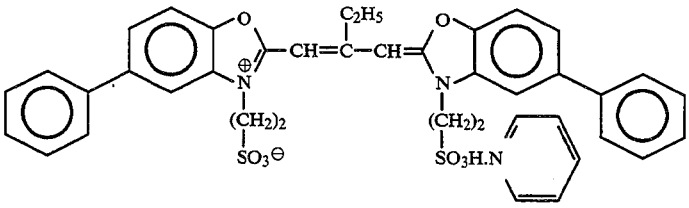

($4.0\times10^{-4}$ mole per mole of silver halide to the large size emulsion B and $5.6\times10^{-4}$ mole per mole of silver halide to the small size emulsion B), and Sensitizing dye D

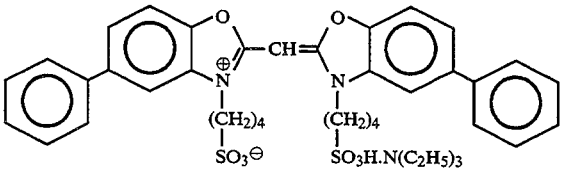

($7.0\times10^{-5}$ mole per mole of silver halide to the large size emulsion B and $1.0\times10^{-5}$ mole per mole of silver halide to the small size emulsion B).

Red-sensitive emulsion layer
Sensitizing dye E

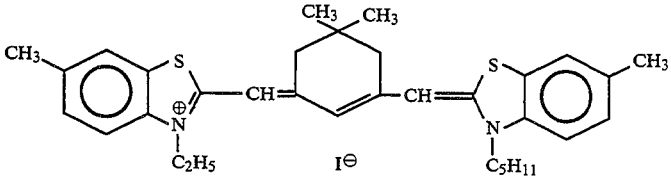

Compound F

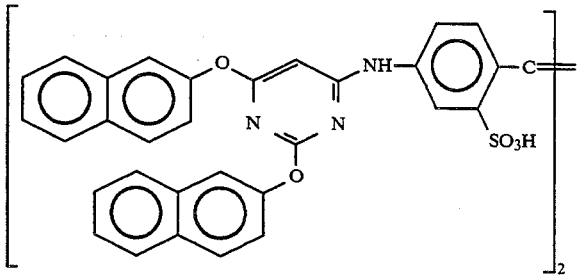

Further, 1-(5-methylureidophenyl)-5-mercaptotetrazole was added to the blue-sensitive layer, green-sensitive layer and red-sensitive layer in the amounts of $8.5\times10^{-5}$ mole, $7.7\times10^{-4}$ mole and $2.5\times10^{-4}$ mole per mole of silver halide, respectively.

Further, 4-hydroxy-6-methyl-1,3,3a,7-tetrazaindene was added to the blue-sensitive layer and green-sensitive layer in the amounts of $1\times10^{-4}$ mole and $2\times10^{-4}$ mole per mole of silver halide, respectively.

The following dye (the number in the parenthesis represents the coated amount) was added to an emulsion layer for preventing irradiation:

To the first layer (blue-sensitive emulsion layer)

-continued

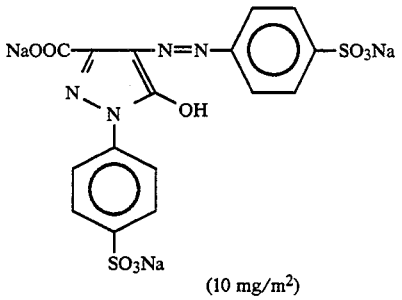

(10 mg/m²)

To the 3rd layer (green-sensitive emulsion layer)

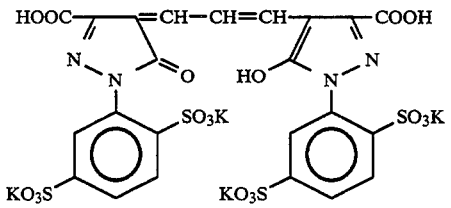

(10 mg/m²)

To the 5th layer (red-sensitive emulsion layer)

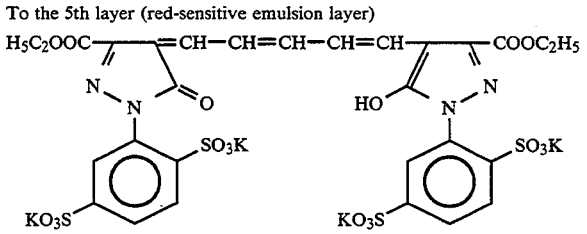

(40 mg/m²)

and

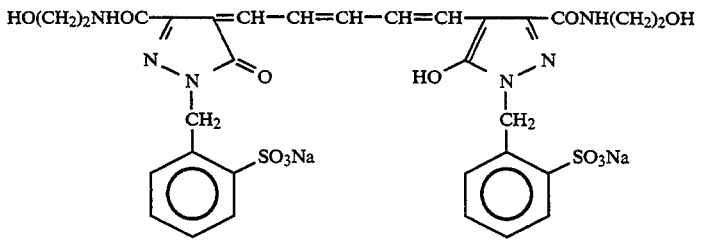

(20 mg/m²)

Layer constitution

The compositions of the respective layers are shown below. The numbers represent the coated amounts (g/m²). The coated amounts of the silver halide emulsions are expressed in terms of the amounts converted to silver.

Support

Polyethylene laminated paper (polyethylene coated on the 1st layer side contains a white pigment/$TiO_2$ and a blue dye/ultramarine).

| | |
|---|---|
| First layer: a blue-sensitive emulsion layer | |
| Above silver bromochloride emulsion A | 0.27 |
| Gelatin | 1.25 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-6) | 0.13 |
| Second layer: a color mixing prevention layer | |
| Gelatin | 1.00 |
| Color mixing prevention agent (Cpd-4) | 0.06 |
| Solvent (Solv-7) | 0.03 |

-continued

| | |
|---|---|
| Solvent (Solv-2) | 0.25 |
| Solvent (Solv-3) | 0.25 |
| Third layer: a green-sensitive emulsion layer | |
| Silver bromochloride emulsion (cubic; 1:3 mixture (Ag mole ratio) of a large size emulsion B having an average grain size of 0.55 μm and a small size emulsion B having an average grain size of 0.39 μm, wherein the variation coefficients of the grain size distributions were 0.10 and 0.08, respectively, and both size emulsions contained grains in which AgBr 0.8 mol % was located on a part of the surface thereof) | 0.13 |
| Gelatin | 1.25 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Dye image stabilizer (Cpd-16) | 0.10 |
| Solvent (Solv-3) | 0.50 |
| Solvent (Solv-4) | 0.15 |
| Solvent (Solv-5) | 0.15 |
| Fourth layer: a color mixing prevention layer | |
| Gelatin | 0.70 |
| Color mixing prevention agent (Cpd-4) | 0.04 |
| Solvent (Solv-7) | 0.02 |
| Solvent (Solv-2) | 0.18 |
| Solvent (Solv-3) | 0.18 |
| Fifth layer: a red-sensitive emulsion layer | |
| Above silver bromochloride emulsion C | 0.20 |
| Gelatin | 1.15 |
| Cyan coupler (ExC) | 0.30 |
| UV absorber (UV-2) | 0.18 |
| Dye image stabilizer (Cpd-1) | 0.30 |
| Dye image stabilizer (Cpd-9) | 0.15 |
| Dye image stabilizer (Cpd-10) | 0.15 |
| Dye image stabilizer (Cpd-11) | 0.01 |
| Solvent (Solv-3) | 0.45 |
| Dye image stabilizer (Cpd-8) | 0.01 |
| Dye image stabilizer (Cpd-6) | 0.01 |
| Solvent (Solv-1) | 0.02 |
| Sixth layer: a UV absorbing layer | |
| Gelatin | 0.55 |
| UV absorber (UV-1) | 0.38 |
| Dye image stabilizer (Cpd-12) | 0.15 |
| Dye image stabilizer (Cpd-5) | 0.02 |
| Seventh layer: a protective layer | |
| Gelatin | 1.13 |
| Acryl-modified copolymer of polyvinyl alcohol (modification degree: 17%) | 0.05 |
| Liquid paraffin | 0.02 |
| Dye image stabilizer (Cpd-13) | 0.01 |

Yellow coupler (ExY)

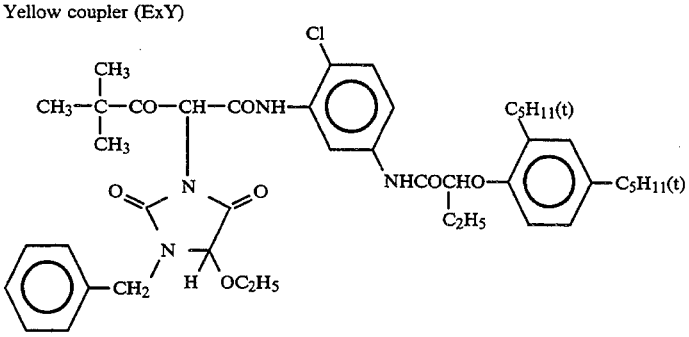

Magenta coupler (ExM)
1:1 mixture (mole ratio) of

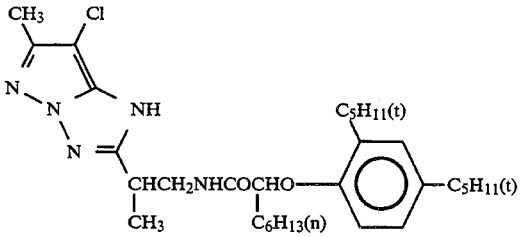

and

-continued
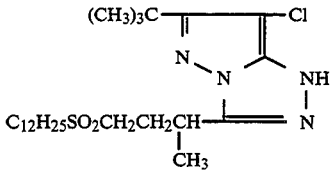
Cyan coupler (ExC)
3:7 mixture (mole ratio) of
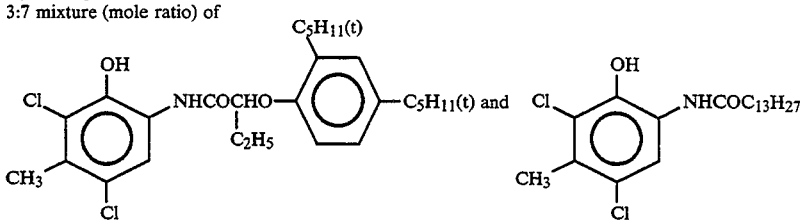
Dye image stabilizer (Cpd-l)
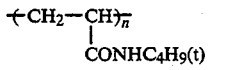
(Average molecular weight 60,000)
Dye image stabilizer (Cpd-2)
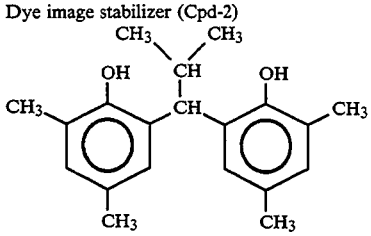
Dye image stabilizer (Cpd-3)
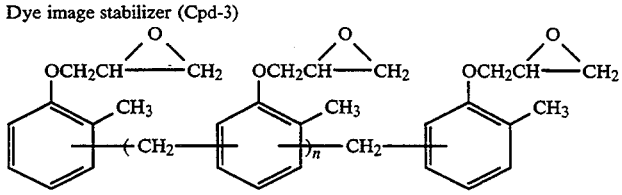
n = 7 to 8 (average value)
Color mixing prevention agent (Cpd-4)
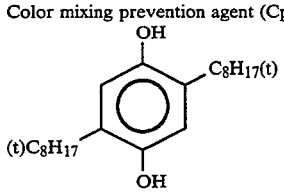
Dye image stabilizer (Cpd-5)
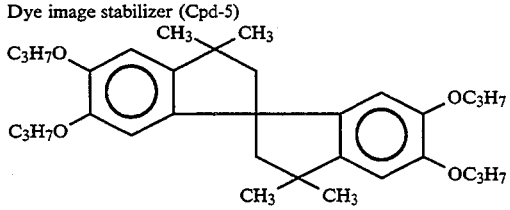
(Cpd-6)
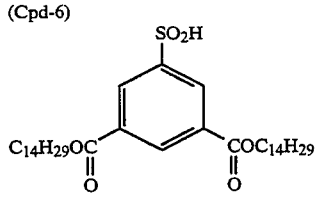
(Cpd-7)
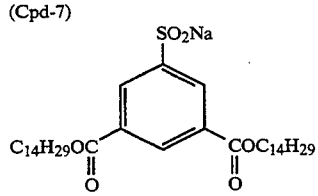

-continued
Dye image stabilizer (Cpd-8)
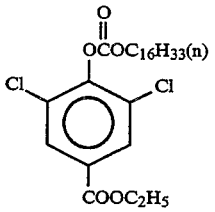
Dye image stabilizer (Cpd-9)
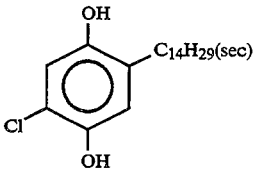
Dye image stabilizer (Cpd-10)
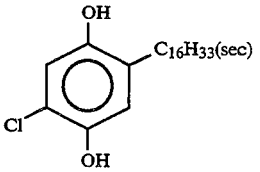
(Cpd-11)
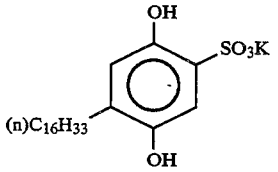
(Cpd-12)
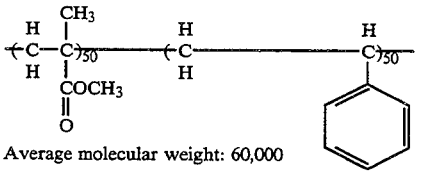
Average molecular weight: 60,000
(Cpd-13)
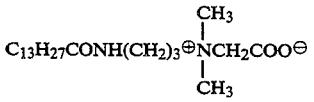
Preservative (Cpd-14)
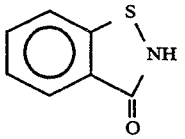
Preservative (Cpd-15)
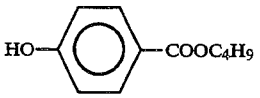
Image Stabilizer (Cpd-16)
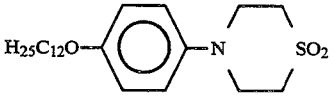
UV absorber (UV-1)

-continued
10:5:1:5 mixture (weight ratio) of
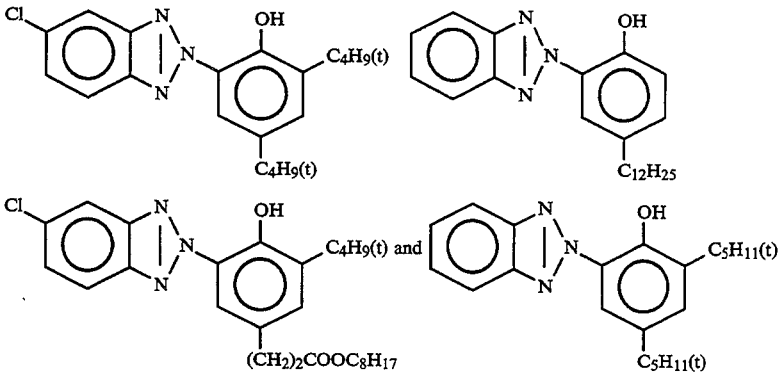
UV absorber (UV-2)
1:2:2 mixture (weight ratio) of
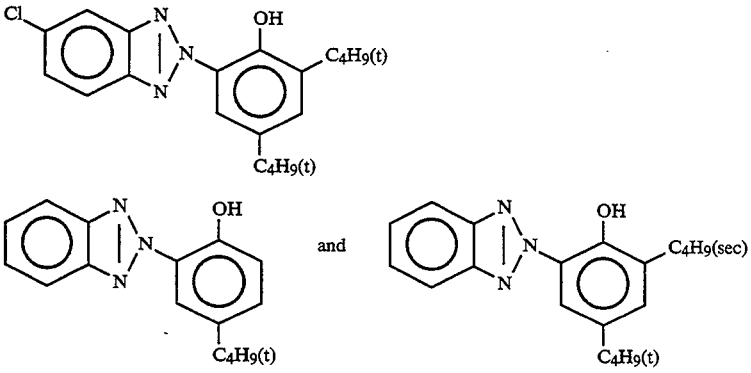
Solvent (Solv-l)
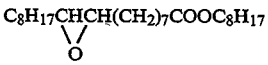
Solvent (Solv-2)
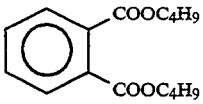
Solvent (Solv-3)
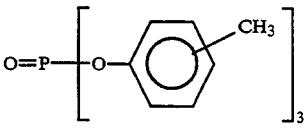
Solvent (Solv-4)
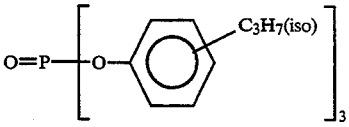
Solvent (Solv-5)
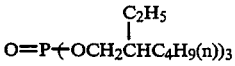
Solvent (Solv-6)
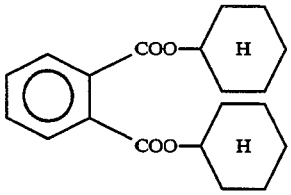
Solvent (Solv-7)

-continued

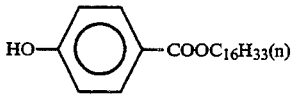

The sample thus prepared was designated as Sample 301.

Next, Samples 302 to 308 were prepared in the same manner as Sample 301 except that the cyan coupler ExC used for the fifth layer (the red-sensitive emulsion layer) was replaced with equimolar amounts of couplers of the present invention as shown in Table 17.

The above photographic materials thus prepared were subjected to an imagewise exposure and then to a continuous processing (a running test) using the following steps with a paper processing machine until the replenishing solution became two times as much as the tank capacity of the color developing solution. Then, the samples were processed for evaluating the performances.

| Processing step | Temperature | Time | Replenishing solution* | Tank capacity |
|---|---|---|---|---|
| Color developing | 38.5° C. | 45 seconds | 73 ml | 20 l |
| Bleach/fixing | 35° C. | 45 seconds | 60 ml** | 20 l |
| Rinsing (1) | 35° C. | 30 seconds | — | 10 l |
| Rinsing (2) | 35° C. | 30 seconds | — | 10 l |
| Rinsing (3) | 35° C. | 30 seconds | 360 ml | 10 l |
| Drying | 80° C. | 60 seconds | | |

*Replenishing amount is per meter of the photographic material.
**In addition to the above 60 ml, 120 ml per $m^2$ of the photographic material were allowed to flow into the bleach-fixing bath from Rinsing (1).

The rinsing step employed a 3 tank countercurrent system from Rinsing (3) to (1).

The compositions of the respective processing solutions were as follows:

| | Tank Solution | Replenishing solution |
|---|---|---|
| Color developer solution | | |
| Water | 800 ml | 800 ml |
| Ethylenediaminetetracetic acid | 3.0 g | 3.0 g |
| Disodium 4,5-dihydroxybenzene-1,3-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent whitening agent (Whitex 4 manufactured by Sumitomo Chemical Co., Ltd.) | 1.0 g | 3.0 g |

-continued

| | Tank Solution | Replenishing solution |
|---|---|---|
| Sodium sulfite | 0.1 g | 0.1 g |
| Disodium N,N-bis(sulfonatethyl)hydroxylamine | 5.0 g | 10.0 g |
| Sodium triisopropylnaphthalene-(β)sulfonate | 0.1 g | 0.1 g |
| N-ethyl-N-(β-methanesulfonamidoethyl)-3-methyl-4-aminoaniline 3/2 sulfate monohydrate | 5.0 g | 11.5 g |
| Water was added to | 1000 ml | 1000 ml |
| pH (adjusted with potassium hydroxide and sulfuric acid at 25° C.) | 10.00 | 11.00 |
| Bleach/fixing solution | | |
| Water | 600 ml | 150 ml |
| Ammonium thiosulfate (700 g/liter) | 100 ml | 250 ml |
| Ammonium sulfite | 40 g | 100 g |
| Iron (III) ammonium ethylenediaminetetracetate | 55 g | 135 g |
| Ethylenediaminetetracetic acid | 5 g | 12.5 g |
| Ammonium bromide | 40 g | 75 g |
| Nitric acid (67%) | 30 g | 65 g |
| Water was added to | 1000 ml | 1000 ml |
| pH (adjusted with acetic acid and aqueous ammonia at 25° C.) | 5.8 | 5.6 |
| Rinsing solution (the tank solution and replenishing solution were the same) | | |
| Sodium chlorinated isocyanurate | 0.02 g | |
| Deionized water (dielectric constant: 5 μs/cm or less) | 1000 ml | |
| pH | 6.5 | |

The processed samples were subjected to a density measurement for each of B, G and R. The photographic characteristics (sensitivity and color density) for the R density in the characteristic curve obtained were evaluated in the same manner as Example 1, and the dye image fastness and color reproducibility were evaluated as well in the same manner as Example 1.

With respect to the dye image fastness, the light fastness was measured in the same manner as the evaluation of the foregoing heat fastness (100° C.) and heat/humidity fastness (80° C. and 70% RH) by exposing for 10 days with a xenon fading tester (illuminance: 90,000 lux).

The photographic characteristics and color reproducibility were evaluated with Sample 301 used as the reference.- The results are shown in Table 17.

TABLE 17

| Sample No. | Cyan coupler used for the 5th layer (red-sensitive layer) | Photographic characteristics ΔS | Photographic characteristics D (%) | Dye image fastness Heat/humd. (80° C., 70%) | Dye image fastness Heat (100° C.) | Dye image fastness Light (Xe) | Color reproducibility |
|---|---|---|---|---|---|---|---|
| 301 (Comp.) | ExC | 0.00 | 100* | 90 | 87 | 90 | 0.00* |
| 302 (Inv.) | (1)/1C-3/2C-15 = 2/1/1 | +0.10 | 130 | 98 | 99 | 97 | −0.05 |
| 303 (Inv.) | (1)/1C-4/2C-17 = 2/1/1 | +0.10 | 128 | 98 | 99 | 97 | −0.05 |
| 304 (Inv.) | (1)/1C-5/2C-27 = 3/1/1 | +0.15 | 139 | 99 | 98 | 96 | −0.06 |
| 305 (Inv.) | (1)/(34)/1C-7 = 2/1/1 | +0.15 | 143 | 95 | 97 | 95 | −0.06 |
| 306 (Inv.) | (39)/1C-1/3-(11)/3-(21) = 6/2/1/1 | +0.12 | 123 | 96 | 98 | 95 | −0.06 |

TABLE 17-continued

| Sample No. | Cyan coupler used for the 5th layer (red-sensitive layer) | Photographic characteristics ΔS | D (%) | Dye image fastness Heat/humd. (80° C., 70%) | Heat (100° C.) | Light (Xe) | Color reproducibility |
|---|---|---|---|---|---|---|---|
| 307 (Inv.) | (39)/1C-6/1C-1/2C-(11) = 5/1/2/2 | +0.09 | 126 | 98 | 97 | 95 | −0.05 |
| 308 (Inv.) | (20)/1C-8/1C-5/2C-(15) = 7/1/1/1 | +0.17 | 145 | 98 | 97 | 96 | −0.07 |

*Standard

It can be confirmed from the results summarized in Table 17 that the combined use of a pyrrolotriazole type cyan coupler of the present invention represented by Formula (I) or (II) and a coupler of the present invention represented by Formula (III), (IV), (V) or (VI) can provide good color developability (i.e., good sensitivity and color density) and excellent dye image fastness and color reproducibility.

EXAMPLE 4

Sample 302 disclosed in Example 3 of JP-A-2-854 was prepared according to the same manner as disclosed therein.

Separately, Sample 401 of the present invention was prepared in the same manner as of Sample 302 of JP-A-2-854, except that the cyan coupler ExC-3 which was one of the couplers used in the Sample 302 of JP-A-2-854 was replaced by exemplified coupler (3) of the present invention, in a mole ratio of ExC-1/ExC-2/(3) being 1/1/2. A total amount of couplers used in the Sample 401 was controlled to be the equimolar as of the Sample 302.

Further, Sample 402 was prepared in the same manner as of the Sample 401, except that the exemplified coupler (3) was replaced by the equimolar exemplified coupler (16).

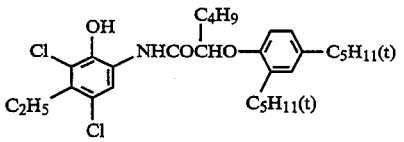

ExC-1

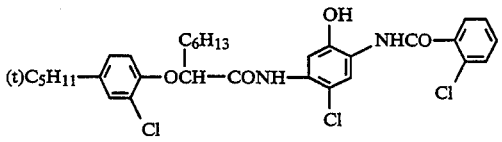

ExC-2

These samples were cut and subjected to a wedge exposure via a three color separation filter. Then, they were subjected to a continuous processing using the processing steps described in Example 3 of JP-A-2-854 with an automatic developing machine until the accumulated replenishing amount of the color developing solution became three times as much as the tank capacity, and then, they were subjected to a processing for evaluating the performances.

The samples thus obtained after processing were subjected to a performance evaluation for the cyan dye image in the same manner as the foregoing Example 3.

It could be confirmed from the results thus obtained that Sample 402 in which a pyrrolotriazole type cyan coupler of the present invention represented by Formula (I) or (II) and a coupler of the present invention represented by Formula (III) or (IV) were used in combination gave high sensitivity and color density and provided excellent dye image fastness and color reproducibility in comparison with Sample 302 in Example 3 of JP-A-2-854. In particular, it was found that Sample 402 had excellent dye image fastness.

EXAMPLE 5

The Samples 101 to 105 and Samples 301 to 308, which were obtained in Examples 1 and 3, respectively were evaluated in terms of following properties.

(1) Color developability (a) These samples were subjected to a wedge exposure via red color separation filter provided in front of the wedge, in the same manner as of the Example 1 and to an imagewise exposure before a continuous color development. Subsequently, the samples were subjected to the continuous color development processing (a running test) according to the Example 3 until a replenishing solution became five times as much as a tank capacity of the color developing solution. Then, the samples were processed for evaluating the performances.

The samples, thus treated, were subjected to a density measurement for evaluating a sensitivity and density in the same manner as Example 1. A sensitivity difference ($\Delta S_1$) and density rate ($D_1$%) were calculated with referring to the results of the samples obtained prior to subjecting the continuation development as a standard.

(b) Separately, the samples exposed as above were subjected to the same continuous color development as above for 45 seconds at 40° C. except that the color developing solution as stated below was used with a replenishing rate of 40 ml/m$^2$. The sensitivity and color density were obtained in the same manner as above, and a sensitivity difference ($\Delta S_2$) and a density rate ($D_1$%) were calculated respectively.

Color developing solution (modified)

| | Tank Solution | Replenishing Solution |
|---|---|---|
| Water | 800 ml | 800 ml |
| Ethylenediaminetetracetic Acid | 3.0 g | 5.0 g |
| Disodium 4,5-dihydroxybenzene-1,3-disulfonate | 0.5 g | 0.5 g |
| Triethanolamine | 12.0 g | 12.0 g |
| Potassium chloride | 8.0 g | — |
| Potassium bromide | 0.03 g | — |
| Potassium carbonate | 27.0 g | 27.0 g |
| Fluorescent whitening agent (Whitex 4, manufactured by Sumitomo Chemical Co., Ltd.) | 1.0 g | 5.0 g |
| Sodium sulfite | 0.1 g | 0.1 g |
| Disodium N,N-bis(sulfonatoethyl)hydroxylamine | 5.0 g | 15.0 g |
| Sodium triisopropylnaphthalene(β)sulfonate | 0.1 g | 0.1 g |
| N-Ethyl-N-(β-methanesulfonamidoethyl)-3-methyl-4-aminoaniline 3/2 sulfate monohydrate | 5.0 g | 18.0 g |
| Water to make | 1000 ml | 1000 ml |
| pH (adjusted with potassium hydroxide and sulfuric acid | 10.2 | 12.2 |

-continued

| Color developing solution (modified) | Tank Solution | Replenishing Solution |
|---|---|---|
| at 25° C.) | | |

(2) Color reproducibility

The samples, which were processed in continuous development for evaluating the color producibility in (a) above, were used to determine a color reproducibility. Red and blue densities of the samples were measured initially and measured again after storing the same at 60° C., under 70% relative humidity, for 2 months.

From characteristic curves, a blue densities obtained at an exposure providing with the minimum density +2.0 of red density, were given at a starting and finishing of the continuous developing treatment, respectively. An increment of yellow color densities in cyan density after storing the samples under high humidity at higher temperature was evaluated as one of the color reproducibility.

TABLE 18

| | Color Developability | | | | Color |
|---|---|---|---|---|---|
| | Continuous Treatment | | Low Replenishing Rate | | Reproducibility |
| Sample | $\Delta S_1$ | $D_1$ (%) | $\Delta S_2$ | $D_2$ (%) | (Color change) |
| 101 (Comparison) | −0.02 | 96 | −0.04 | 93 | 0.04 |
| 102 (Comparison) | −0.02 | 96 | −0.04 | 92 | 0.04 |
| 103 (Comparison) | −0.03 | 95 | −0.06 | 89 | 0.07 |
| 104 (Comparison) | −0.04 | 94 | −0.07 | 87 | 0.06 |
| 105 (Comparison) | −0.06 | 91 | −0.10 | 84 | 0.09 |
| 301 (Comparison) | −0.06 | 91 | −0.10 | 83 | 0.09 |
| 302 (Invention) | −0.02 | 98 | −0.02 | 97 | 0.02 |
| 303 (Invention) | −0.02 | 98 | −0.02 | 97 | 0.02 |
| 304 (Invention) | −0.00 | 100 | −0.01 | 98 | 0.02 |
| 305 (Invention) | −0.02 | 99 | −0.02 | 97 | 0.02 |
| 306 (Invention) | −0.03 | 97 | −0.03 | 95 | 0.03 |
| 307 (Invention) | −0.03 | 97 | −0.03 | 95 | 0.03 |
| 308 (Invention) | −0.02 | 99 | −0.03 | 97 | 0.01 |

It is apparent from the results of Table 18 above, Samples 302 to 308 which satisfied the requirements of the present invention show stable color developability in the continuous developing treatment comparing with the Comparison Samples 101 to 105 and 301, and show excellent color developability even when essential development conditions are changed to those in the lower replenishing state.

Furthermore, an excellent image preservation is provided to maintain excellent color reproducibility without suffering from hue variety due to increasing yellow color component when the images are stored at high temperature under high humidity for a long period of time.

In particular, according to the present invention, a combination use of the pyrrolotriazole cyan coupler and cyan couplers represented by formulae (III) to (VI) shows unexpectedly superior color developability, color reproducibility and image stability than those used these couplers alone.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon at least one silver halide emulsion layer containing at least one pyrrolotriazole cyan coupler represented by the following Formula (I-a) or (II-a) and at least one coupler selected from the phenol or 1-naphthol cyan couplers represented by the following Formulas (III), (IV), (V) and (VI):

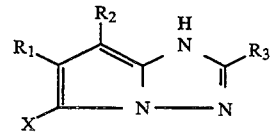

(I-a)

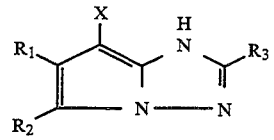

(II-a)

wherein $R_1$ and $R_2$ each independently represents an electron attractive group having a Hammett's substituent constant $\sigma_p$ of 0.2 or more and the sum of the $\sigma_p$ values of $R_1$ and $R_2$ is 0.65 or more; $R_3$ represents a hydrogen atom or a substituent; X represents a hydrogen atom or a group capable of splitting off upon a reaction with an oxidation product of an aromatic primary amine color developing agent; the group represented by $R_1$, $R_2$, $R_3$ or X may be a divalent group and combine with a polymer which is higher than a dimer and which has a high molecular chain to form a homopolymer or a copolymer;

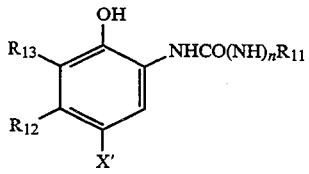

(III)

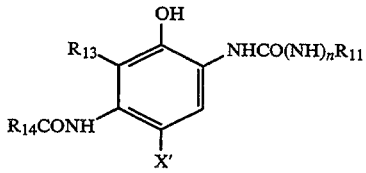

(IV)

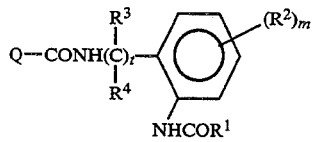

(V)

-continued

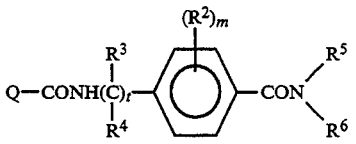

(VI)

in Formulas (III) and (IV), $R_{11}$ represents an alkyl group, an aryl group or a heterocyclic group; $R_{12}$ represents an alkyl group having two or more carbon atoms; $R_{13}$ represents a hydrogen atom, a halogen atom, an alkyl group, an aryl group, an alkoxy group, an aryloxy group, a carbonamido group, or a ureido group; $R_{14}$ represents an alkyl group, an aryl group, a heterocyclic group, an alkoxy group, an aryloxy group, or an amino group; X' represents a hydrogen atom or a group capable of splitting off upon a reaction with an oxidation product of an aromatic primary amine color developing agent; n represents 0 or 1; $R_{12}$ and $R_{13}$ in Formula (III) may be combined with each other to form a ring, and $R_{13}$ and $R_{14}$ in Formula (IV) may be combined with each other to form a ring; in Formulas (V) and (VI), Q represents a 1-naphthol coupler group which is bonded at the 2-position; $R^1$ represents a hydrogen atom, an alkyl group, an alkenyl group, an alkynyl group, an amino group, or an aryl group; $R^2$ represents a substituent group; $R^3$ and $R^4$ each represents a hydrogen atom, an alkyl group, an aryl group, a halogen atom, an alkoxy group, or an aryloxy group; $R^5$ or $R^6$ each represents a hydrogen atom, an alkyl group, or an aryl group; and t represents an integer of 0 to 4 and m represents an integer of 0 to 4.

2. The silver halide color photographic material of claim 1, wherein $R_3$ represents a hydrogen atom, a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, or an azolyl group.

3. The silver halide color photographic material of claim 2, wherein $R_3$ represents an alkyl group or an aryl group.

4. The silver halide color photographic material of claim 1, wherein the electron attractive group of $R_1$ and $R_2$ having a Hammett's substituent constant $\sigma_p$ of 0.2 or more, each independently represents an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with an electron attractive group having $\sigma_p$ of 0.20 or more, a heterocyclic group, a halogen atom, an azo group, or a selenocyanate group.

5. The silver halide color photographic material of claim 4, wherein $R_1$ represents a cyano group.

6. The silver halide color photographic material of claim 4, wherein $R_2$ represents an alkoxycarbonyl group, or an aryloxycarbonyl group.

7. The silver halide color photographic material of claim 4, wherein $R_2$ represents a branched alkoxycarbonyl group.

8. The silver halide color photographic material of claim 1, wherein X represents a hydrogen atom, a halogen atom, an alkoxy group, an aryloxy group, an acyloxy group, an alkyl or arylsulfonyloxy group, an acylamino group, an alkyl or arylsulfonamido group, an alkoxycarbonyloxy group, an aryloxycarbonyloxy group, an alkyl, aryl or heterocyclic thio group, a carbamoylamino group, a 5-membered or 6-membered nitrogen-containing heterocyclic group, an imido group, or an arylazo group.

9. The silver halide color photographic material of claim 8, wherein X represents a halogen atom, an alkylthio group or an arylthio group.

10. The silver halide color photographic material of claim 1, wherein a pyrrolotriazole cyan coupler is represented by Formula (I-a).

11. The silver halide color photographic material of claim 1, wherein $R_{12}$ of formula (III) represents an alkyl group having 2 to 8 carbon atoms.

12. The silver halide color photographic material of claim 1, wherein a pyrrolotriazole cyan coupler represented by Formula (I-a) or (II-a) is incorporated in a red-sensitive emulsion layer.

13. The silver halide color photographic material of claim 1, wherein a pyrrolotriazole cyan coupler represented by Formula (I-a) or (II-a) is incorporated in an emulsion layer having a sensitivity in the near infrared region.

14. The silver halide color photographic material of claim 1, wherein the 1-naphthol cyan coupler represented by Formula (V) or (VI) is represented by Formula (3-1a), (3-1b), (3-2b) or (3-2c):

(3-1a)

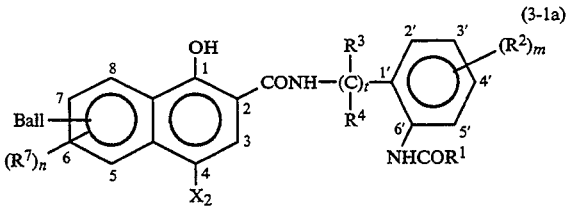

(3-1b)

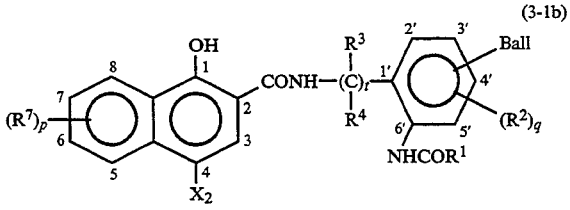

-continued

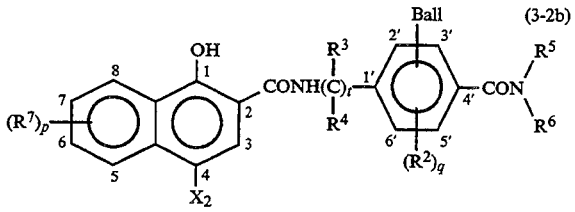

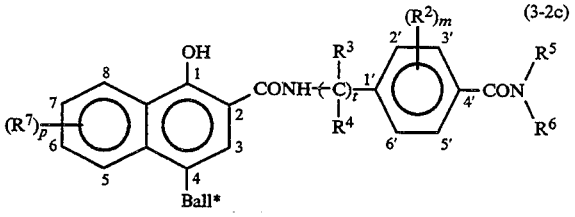

wherein $R^1$ represents a hydrogen atom, an alkyl group, an alkenyl group, an alkynyl group, a cycloalkyl group, an aralkyl group, an alkoxy group, an amino group, or an aryl group; $R^2$ represents a group substitutable on a benzene ring; $R^3$ and $R^4$ each represents a hydrogen atom, an alkyl group, an aryl group, a halogen atom, an alkoxy group, or an aryloxy group; $R^5$ and $R^6$ each represents a hydrogen atom, an alkyl group, or an aryl group; $R^7$ represents a group substitutable on a naphthalene ring; Ball represents a ballast group; Ball* represents a coupling splitting-off group which is a ballast group; X represents a hydrogen atom or a coupling splitting-off group; t, m and n each represents an integer of 0 to 4; p represents an integer of 0 to 5; and q represents an integer of 0 to 3.

15. The silver halide color photographic material of claim 1, wherein the mixing ratio of the pyrrolotriazole cyan couplers represented by formulae (I-a) or (II-a) and the cyan couplers represented by formulae (III) to (VI) is 30 mol % or more and 99 mol % or less.

16. The silver halide color photographic material of claim 15, wherein the mixing ratio is 50 mol % or more and 90 mol % or less.

17. The silver halide color photographic material of claim 1, wherein an amount of a mixture of the pyrrolotriazole type cyan couplers of formulae (I-a) or (II-a) and the cyan coupler of formulae (III) to (VI) is $1\times10^{-3}$ to 2 mole.

* * * * *